US007371512B2

(12) United States Patent
Ihama

(10) Patent No.: US 7,371,512 B2
(45) Date of Patent: May 13, 2008

(54) SILVER HALIDE PHOTOGRAPHIC EMULSION AND SILVER HALIDE PHOTOGRAPHIC LIGHTSENSITIVE MATERIAL USING THE SAME

(75) Inventor: Mikio Ihama, Minami-Ashigara (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 09/778,874

(22) Filed: Feb. 8, 2001

(65) Prior Publication Data

US 2001/0031434 A1 Oct. 18, 2001

(30) Foreign Application Priority Data

Feb. 23, 2000 (JP) ..... 2000-046268

(51) Int. Cl.
*G03C 1/005* (2006.01)

(52) U.S. Cl. ..... 430/567; 430/569

(58) Field of Classification Search ..... 430/567, 430/569

See application file for complete search history.

(56) References Cited

U.S. PATENT DOCUMENTS

| | | | | |
|---|---|---|---|---|
| 5,494,789 | A | 2/1996 | Daubendiek et al. | |
| 5,496,694 | A | 3/1996 | Kikuchi et al. | |
| 5,534,399 | A | 7/1996 | Mihayashi et al. | |
| 5,536,632 | A * | 7/1996 | Wen et al. | 430/567 |
| 5,582,965 | A | 12/1996 | Deaton et al. | |
| 5,612,175 | A | 3/1997 | Eshelman et al. | |
| 5,612,176 | A | 3/1997 | Eshelman et al. | |
| 5,612,177 | A | 3/1997 | Levy et al. | |
| 5,614,359 | A | 3/1997 | Eshelman et al. | |
| 5,629,144 | A | 5/1997 | Daubendiek et al. | |
| 5,631,126 | A | 5/1997 | Daubendiek et al. | |
| 5,691,127 | A | 11/1997 | Daubendiek et al. | |
| 5,698,387 | A * | 12/1997 | Reed et al. | 430/567 |
| 5,723,278 | A * | 3/1998 | Jagannathan et al. | 430/567 |
| 5,726,007 | A | 3/1998 | Deaton et al. | |
| 5,792,601 | A | 8/1998 | Edwards et al. | |
| 5,919,611 | A | 7/1999 | Maruyama | |
| 6,007,977 | A * | 12/1999 | Nishikawa | 430/567 |
| 6,045,984 | A | 4/2000 | Hoshino | |
| 6,090,535 | A | 7/2000 | Morimura | |
| 6,100,019 | A * | 8/2000 | Brust et al. | 430/569 |
| 6,153,370 | A * | 11/2000 | Maruyama et al. | 430/567 |
| 6,338,940 | B1 | 1/2002 | Miyazawa et al. | |
| 6,432,626 | B1 | 8/2002 | Sugimoto et al. | |
| 6,544,725 | B2 | 4/2003 | Morimoto | |
| 2002/0061482 | A1 | 5/2002 | Ihama et al. | |

FOREIGN PATENT DOCUMENTS

| | | |
|---|---|---|
| JP | 5-323485 A | 12/1993 |
| JP | 8069069 | 3/1996 |
| JP | 8101472 | 3/1996 |
| JP | 8101473 | 3/1996 |
| JP | 8101474 | 3/1996 |
| JP | 8101475 | 3/1996 |
| JP | 8101476 | 3/1996 |
| JP | 8171162 | 3/1996 |
| JP | 8171163 | 3/1996 |
| JP | 9-197595 A | 7/1997 |
| JP | 9-319018 A | 12/1997 |
| JP | 10-62891 A | 3/1998 |
| JP | 10-123689 A | 5/1998 |
| JP | 10-268456 A | 10/1998 |
| JP | 10-307355 A | 11/1998 |
| JP | 11-95348 A | 4/1999 |
| JP | 11-194457 A | 7/1999 |
| JP | 11-218866 A | 8/1999 |
| JP | 11-352619 A | 12/1999 |
| JP | 2000-19666 A | 1/2000 |
| JP | 2000-267212 A | 9/2000 |
| JP | 2000-321696 A | 11/2000 |
| JP | 2001-66739 A | 3/2001 |
| JP | 2001-92057 A | 4/2001 |
| JP | 2001-235821 A | 8/2001 |

OTHER PUBLICATIONS

Research Disclosure 39121, Nov. 1996 (p. 717).*

* cited by examiner

*Primary Examiner*—Amanda C. Walke
(74) *Attorney, Agent, or Firm*—Birch, Stewart, Kolasch & Birch LLP

(57) ABSTRACT

A silver halide photographic emulsion comprising grains is characterized that 70% or more of the total projected area of the grains are occupied by tabular grains meeting requirements (i) to (v) below:

(i) silver bromochloroiodide grains having (111) faces as major surfaces, (ii) hexagonal grains having a ratio of the length of an edge having the maximum length to the length of an edge having the minimum length of not more than 2, (iii) perfect epitaxial grains having a total of six epitaxial junctions each existing only in each of six apex portions of the hexagonal grains, (iv) the silver chloride content is 1 to 6 mol %, and (v) the silver iodide content is 0.5 to 10 mol %.

13 Claims, No Drawings

SILVER HALIDE PHOTOGRAPHIC EMULSION AND SILVER HALIDE PHOTOGRAPHIC LIGHTSENSITIVE MATERIAL USING THE SAME

CROSS-REFERENCE TO RELATED APPLICATIONS

This application is based upon and claims the benefit of priority from the prior Japanese Patent Application No. 2000-046268, filed Feb. 23, 2000, the entire contents of which are incorporated herein by reference.

BACKGROUND OF THE INVENTION

The present invention relates to a silver halide photographic emulsion used in a silver halide photographic lightsensitive material and, more particularly, to a high-speed silver halide photographic emulsion having high storage stability and superior in development dependence. The present invention also relates to a silver halide photographic lightsensitive material using this silver halide photographic emulsion.

The use of tabular silver halide grains (to be referred to as "tabular grains" hereinafter) to obtain a high-speed silver halide photographic lightsensitive material is well known to those skilled in the art. As methods of sensitizing these tabular grains, methods of sensitizing by using epitaxial junctions are disclosed in Jpn. Pat. Appln. KOKAI Publication No. (hereinafter referred to as JP-A-) 58-108526 and JP-A-59-133540. Also, applications to thinner tabular grains or to tabular grains having larger equivalent-circle diameters are disclosed in JP-A's-8-69069, 8-101472, 8-101474, 8-101475, 8-171162, 8-171163, 8-101473, 8-101476 (the above JP-A's correspond to U.S. Pat. No. 5,494,789), 9-211762 (which corresponds to U.S. Pat. No. 5,612,175), and 9-211763 (which corresponds to U.S. Pat. No. 5,612,177), and U.S. Pat. Nos. 5,612,176, 5,614,359, 5,629,144, 5,631,126, 5,691,127, and 5,726,007. However, an epitaxial sensitization method using silver chloride as a principal constituent element is basically unstable in a sensitive material for photography constructed using silver iodobromide as a basic constituent element. The reason is that the solubility product of silver chloride is larger than the solubility product of silver bromide and silver iodide, so silver chloride readily undergoes halogen conversion. Therefore, a sensitive material using an epitaxial emulsion lowers its sensitivity or increases fog during storage. Additionally, the unstable solubility of an epitaxial portion varies the KBr amount during development, and this largely changes photographic properties. Hence, the method cannot be used for common sensitive materials for photography.

To make the present invention, the present inventors noted that epitaxial junctions largely vary between grains in conventional epitaxial emulsions. Conventional epitaxial emulsions contain all of tabular grains having 1 to 6 epitaxial junctions at their apexes, tabular grains having epitaxial junctions on their edges, and tabular grains having epitaxial junctions on their major surfaces. The present inventors have found in the present invention that the above problems can be solved by the use of an emulsion in which 70% or more of the total projected area are accounted for by perfect epitaxial tabular grains which are hexagonal tabular grains and having a total of six epitaxial junctions each existing only in each of six apex portions. Furthermore, the present inventors have found that even when the excess bromine ion concentration in an emulsion is raised, i.e., even when the pBr of the emulsion is lowered, epitaxial portions using silver chloride as a constituent element can be stably held. Accordingly, by the use of an epitaxial emulsion having a lowered pBr, the present invention can almost completely solve the problems of storable stability and processability of a sensitive material using this emulsion.

The present invention provides a silver halide photographic emulsion which can increase the sensitivity of tabular grains and at the same time can solve the problems of storage stability and processability, and provides a silver halide photographic lightsensitive material using the emulsion.

BRIEF SUMMARY OF THE INVENTION

It is an object of the present invention to provide a silver halide photographic emulsion having high sensitivity, high storage stability, and small processing dependence, and a photographic lightsensitive material using the emulsion.

The above object is achieved by means (1) to (21) below.

(1) A silver halide photographic emulsion comprising grains, wherein not less than 70% of the total projected area of the grains are occupied by tabular grains meeting requirements (i) to (v) below:

(i) silver bromochloroiodide grains having (111) faces as major surfaces, (ii) hexagonal grains having a ratio of the length of an edge having the maximum length to the length of an edge having the minimum length of not more than 2, (iii) perfect epitaxial grains having a total of six epitaxial junctions each existing only in each of six apex portions of the hexagonal grains, (iv) the silver chloride content is 1 to 6 mol %, and (v) the silver iodide content is 0.5 to 10 mol %.

(2) The silver halide photographic emulsion described in item (1) above, wherein the tabular grains further meet the following requirement:

(vi) an equivalent-circle diameter is not less than 0.6 μm and a thickness is not more than 0.2 μm.

(3) The silver halide photographic emulsion described in item (1) above, wherein the variation coefficient of the equivalent-circle diameters of all the grains is not more than 30%.

(4) The silver halide photographic emulsion described in item (2) above, wherein the variation coefficient of the equivalent-circle diameters of all the grains is not more than 30%.

(5) The silver halide photographic emulsion described in item (1) above, wherein the tabular grains further meet the following requirement:

(vii) an equivalent-circle diameter is not less than 1.0 μm and a thickness is not more than 0.1 μm.

(6) The silver halide photographic emulsion described in item (1) above, wherein the variation coefficient of the equivalent-circle diameters of all the grains is not more than 20%.

(7) The silver halide photographic emulsion described in item (2) above, wherein the variation coefficient of the equivalent-circle diameters of all the grains is not more than 20%.

(8) The silver halide photographic emulsion described in item (5) above, wherein the variation coefficient of the equivalent-circle diameters of all the grains is not more than 20%.

(9) The silver halide photographic emulsion described in item (1) above, wherein the perfect epitaxial grains defined in the requirement (iii) have no dislocation line except in the epitaxial apex portions.

(10) The silver halide photographic emulsion described in item (2) above, wherein the perfect epitaxial grains defined in the requirement (iii) have no dislocation line except in the epitaxial apex portions.

(11) The silver halide photographic emulsion described in item (3) above, wherein the perfect epitaxial grains defined in the requirement (iii) have no dislocation line except in the epitaxial apex portions.

(12) The silver halide photographic emulsion described in item (4) above, wherein the perfect epitaxial grains defined in the requirement (iii) have no dislocation line except in the epitaxial apex portions.

(13) The silver halide photographic emulsion described in item (5) above, wherein the perfect epitaxial grains defined in the requirement (iii) have no dislocation line except in the epitaxial apex portions.

(14) The silver halide photographic emulsion described in item (6) above, wherein the perfect epitaxial grains defined in the requirement (iii) have no dislocation line except in the epitaxial apex portions.

(15) The silver halide photographic emulsion described in item (7) above, wherein the perfect epitaxial grains defined in the requirement (iii) have no dislocation line except in the epitaxial apex portions.

(16) The silver halide photographic emulsion described in item (8) above, wherein the perfect epitaxial grains defined in the requirement (iii) have no dislocation line except in the epitaxial apex portions.

(17) The silver halide photographic emulsion described in item (1) above, wherein the tabular grains further meet the following requirement:

(viii) the silver chloride content of each individual tabular grain is 0.7 to 1.3 CL mol %, wherein CL mol % is the average silver chloride content of all the grains.

(18) The silver halide photographic emulsion described in item (1) above, wherein the tabular grains further meet the following requirement:

(ix) the silver iodide content of each individual tabular grain is 0.7 to 1.3 I mol %, wherein I mol % is the average silver iodide content of all the grains.

(19) The silver halide photographic emulsion described in item (1) above, wherein the pBr of the emulsion at 40° C. is not more than 3.5.

(20) The silver halide photographic emulsion described in item (2) above, wherein the pBr of the emulsion at 40° C. is not more than 3.5.

(21) A silver halide photographic lightsensitive material having a sensitive layer on a support, wherein the sensitive layer contains the silver halide photographic emulsion described in item (1).

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DETAILED DESCRIPTION OF THE INVENTION

A silver halide photographic emulsion of the present invention will be described below.

In the present invention, a tabular grain is a silver halide grain having two opposing parallel (111) major surfaces. A tabular grain used in the present invention has one twin plane or two or more parallel twin planes. A twin plane is a (111) plane on the two sides of which ions at all lattice points have a mirror image relationship.

When viewed in a direction perpendicular to its major surfaces, a tabular grain has a triangular shape, a hexagonal shape, or a rounded triangular or hexagonal shape. Any of these shapes has parallel outer surfaces. Even when a tabular grain has a rounded triangular or hexagonal shape, if its straight edges can be identified, it is possible to check whether the grain is included in the present invention by using a hexagon formed by extending these edges.

In an emulsion of the present invention, 70% or more of the projected area of all grains are hexagonal tabular grains having a ratio of the length of an edge having the maximum length to the length of an edge having the minimum length is 2 or less. The lower limit of this ratio is naturally 1. This makes the preparation of perfect epitaxial tabular grains (to be described later) possible. In the present invention, a perfect epitaxial tabular grain is a hexagonal tabular grain having a total of six epitaxial junctions each existing only in each of six apex portions. Preferably, 90% or more of the projected area of all grains are hexagonal tabular grains having a ratio of the length of an edge having the maximum length to the length of an edge having the minimum length of 2 or less. More preferably, 90% or more of the projected area of all grains are hexagonal tabular grains having a ratio of the length of an edge having the maximum length to the length of an edge having the minimum length of 1.5 to 1. If tabular grains other than the abovementioned hexagonal tabular grains having a ratio of the length of an edge having the maximum length to the length of an edge having the minimum length of 1 to 2 mix at a ratio exceeding 30% of the total projected area, the preparation of perfect epitaxial tabular grains becomes difficult. So, the problems of storage stability and processing dependence cannot be solved.

In an emulsion of the present invention, the variation coefficient of the equivalent-circle diameters of all grains is preferably 30% or less. An emulsion of the present invention is preferably monodisperse. In all silver halide grains used in a sensitive material of the present invention, the variation coefficient of the equivalent-circle diameters of the projected areas of all silver halide grains is preferably 30% or less, more preferably, 25% or less, and most preferably, 20% or less. The variation coefficient of equivalent-circle diameters is the value obtained by dividing the standard deviation of the distribution of the equivalent-circle diameters of individual silver halide grains by their average equivalent-circle diameter. If the monodispersibility worsens, epitaxial deposition becomes nonuniform between grains. This makes the preparation of perfect epitaxial tabular grains of the present invention difficult.

The equivalent-circle diameters of tabular grains are obtained by taking a transmission electron micrograph by using, e.g., the replica method, and calculating the diameter (equivalent-circle diameter) of a circle having an area equal to the projected area of each grain. The thickness of a grain cannot be simply calculated from the length of the shadow of a replica owing to epitaxial deposition. However, the thickness can be calculated by measuring the length of the shadow of a replica before epitaxial deposition. Alternatively, even after epitaxial deposition, the thickness can be readily obtained by cutting a sample coated with tabular grains and taking an electron micrograph of the section of the sample.

In an emulsion of the present invention, 70% or more of the total projected area are tabular grains having an equivalent-circle diameter and thickness of preferably 0.6 μm or more and 0.2 μm or less, respectively, and 10 μm or less and 0.01 μm or more, respectively, and more preferably, 1.0 μm or more and 0.1 μm or less, respectively. Particularly preferably, 90% or more of the total projected area are tabular grains having an equivalent-circle diameter of 1.5 μm or more and a thickness of 0.1 μm or less. As the equivalent-circle diameter increases and the thickness decreases, the surface area of each grain increases, and this makes the preparation of perfect epitaxial tabular grains difficult. However, the preparation of such grains makes the effects of the present invention notable.

Tabular grains used in an emulsion of the present invention are silver bromochloroiodide grains. Basically, host tabular grains are silver bromoiodide grains or silver bromochloroiodide grains, and epitaxial deposition portions are silver chloride, silver bromochloride, or silver bromochloroiodide. The silver chloride content of tabular grains used in an emulsion of the present invention is 1 to 6 mol %, and more preferably, 1 to 5 mol %. The silver iodide content of tabular grains used in an emulsion of the present invention is 0.5 to 10 mol %, and more preferably, 1 to 6 mol %. If these conditions are not met, the preparation of perfect epitaxial tabular grains of the present invention becomes difficult.

In an emulsion of the present invention, 70% or more of the total projected area are tabular grains in which, letting CL mol % be the average silver chloride content, the silver chloride content of each grain is preferably 0.7 to 1.3 CL, and particularly preferably, 0.8 to 1.2 CL. In an emulsion of the present invention, 70% or more of the total projected area are perfect epitaxial tabular grains, so the distribution of the silver chloride contents between the grains is basically monodisperse. Furthermore, 70% or more of the total projected area are tabular grains in which, letting I mol % be the average silver iodide content, the silver iodide content of each grain is preferably 0.7 to 1.3 I, and particularly preferably, 0.8 to 1.2 I. Since the distribution of the silver iodide contents between grains is monodisperse, perfect epitaxial tabular grains can be prepared. The EPMA (Electron Probe Micro Analyzer) method is usually effective to the measurement of the silver chloride content and silver iodide content of each individual grain. By forming a sample in which emulsion grains are dispersed so as not to contact each other and analyzing radiated X-rays by radiating an electron beam, elements in a micro region irradiated with the electron beam can be analyzed. The measurement is preferably performed under cooling at low temperatures in order to prevent damage to the sample by the electron beam.

In an emulsion of the present invention, 70% or more of the total projected area are perfect epitaxial tabular grains having a total of six epitaxial junctions each existing only in each of six apex portions of a hexagon. More preferably, 90% or more of the total projected area are perfect epitaxial tabular grains having a total of six epitaxial junctions each existing only in each of six apex portions of a hexagon. An apex portion means a portion in a circle whose radius is ⅓ the length of a shorter one of two edges adjacent to an apex when a tabular grain is viewed in a direction perpendicular to its major surfaces. An epitaxial apex portion means an apex portion having an epitaxial junction. Even when a tabular grain has a rounded hexagonal shape, if its straight edges can be identified, the length of each edge of a hexagon obtained by extending each edge is used. Also, an apex can be identified as a point having the largest curvature. A grain having one epitaxial junction in each apex portion, i.e., a total of six epitaxial junctions is a perfect epitaxial tabular grain of the present invention. Epitaxial junctions are usually formed on major surfaces or on edges except for apex portions of a tabular grain, as well as epitaxial junctions formed in a perfect epitaxial tabular grain. Perfect epitaxial tabular grains of the present invention are as follows. 100 or more grains are extracted at random from an electron micrograph of replicas of tabular grains and classified into three types of grains: a grain having six epitaxial junctions only in each of apex portions of a hexagon, a grain having five or less epitaxial junctions only in apex portions of a hexagon, and a grain having epitaxial junctions on edges or on major surfaces as well as in apex portions of a hexagon. In the present invention, the grain having six epitaxial junctions only in apex portions of a hexagon is perfect epitaxial tabular grain. In an emulsion of the present invention, 70% or more of the total projected area are perfect epitaxial tabular grains. More preferably, 90% or more of the total projected area are perfect epitaxial tabular grains.

An epitaxial portion is silver chloride, silver bromochloride, or silver bromochloroiodide. The silver chloride content of this epitaxial portion is higher by preferably 1 mol % or more, and more preferably, 10 mol % or more, than that of a host tabular grain. However, the silver chloride content of an epitaxial portion is preferably 50 mol % or less. The silver bromide content of an epitaxial portion is preferably 30 mol % or more, and particularly preferably, 50 mol % or more, and preferably 90 mol % or less. The silver iodide content of an epitaxial portion is preferably 1 to 20 mol %. The silver amount in an epitaxial portion is preferably 0.5 to 10 mol %, and more preferably, 1 to 5 mol % of the silver amount in a host tabular grain.

An emulsion of the present invention meeting above conditions, which contains perfect epitaxial tabular grains, can lower its pBr. The pBr is the logarithm of the reciprocal of a bromine ion concentration. Since the pBr at 40° C. can be decreased to 3.5 or less, the storage stability can be significantly improved. Additionally, the problem of processing dependence can be solved because the emulsion can be incorporated into a sensitive material for photography which is constructed using silver bromoiodide as a basic constituent element. The pBr at 40° C. of an emulsion of the present invention is more preferably 3.0 or less, and most preferably, 2.5 to 1.5.

In the present invention, no dislocation lines are favorably present in portions except for epitaxial apex portions in 70% or more of the total projected area. Dislocation lines provide preferential deposition sites of epitaxial deposition, and dislocation lines in portions except epitaxial apex portions inhibit the formation of perfect epitaxial tabular grains of the present invention. Preferably, no dislocation lines exist in 70% or more of the total projected area, except for epitaxial deposition portions. Most preferably, no dislocation lines exist in 90% or more of the total projected area. Dislocation lines in tabular grains can be observed by a direct method using a transmission electron microscope at a low temperature described in, e.g., J. F. Hamilton, Phot. Sci. Eng., 11, 57, (1967) or T. Shiozawa, J. Soc. Phot. Sci. Japan, 35, 213, (1972). That is, silver halide grains, extracted carefully from an emulsion so as not to apply a pressure at which dislocations are produced in the grains, are placed on a mesh for electron microscopic observation. Observation is performed by a transmission method while the sample is cooled to prevent damage (e.g., print out) due to an electron beam. In this case, as the thickness of a grain is increased, it becomes more difficult to transmit an electron beam through it.

Therefore, grains can be observed more clearly by using an electron microscope of a high voltage type (200 kV or more for a grain having a thickness of 0.25 μm). From photographs of grains obtained by the above method, it is possible to obtain the positions and the number of dislocation lines in each grain viewed in a direction perpendicular to the major surfaces of the grain.

A practical method of preparing aforementioned perfect epitaxial tabular grains of the present invention will be described in detail below separately for the preparation of host tabular grains and the preparation of epitaxial portions.

First, details of host tabular grains necessary for the preparation of perfect epitaxial tabular grains of the present invention will be described. The silver iodide distribution inside a host tabular grain of the present invention preferably has a double structure or a higher-order structure. "The silver iodide distribution has a structure" means that the silver iodide content differs by 0.5 mol % or more, and more preferably, 1 mol % or more, from one layer to another of the structure.

This silver iodide distribution structure can be basically obtained by calculations from the prescribed value in the grain preparation step. In the interface between layers of the structure, the silver iodide content can change either abruptly or moderately. The EPMA method described earlier is effective to confirm this, although the measurement accuracy of analysis must be taken into consideration. By this method, the intra-grain silver iodide distribution of a tabular grain can be analyzed when the grain is viewed in a direction perpendicular to its major surfaces. Additionally, when a specimen obtained by hardening a sample and cutting the sample into a very thin piece using microtome is used, the intra-grain silver iodide distribution in the section of a tabular grain can be analyzed.

In the present invention, the silver iodide content of the outermost shell of a host tabular grain is preferably higher than that of the core. The ratio of the outermost shell is preferably 1 to 40 mol % of the total silver amount, and the average silver iodide content is 1 to 30 mol %. "The ratio of the outermost shell" means the ratio of a silver amount used in the preparation of outermost shells to a silver amount used to obtain final grains. "The average silver iodide content" means % of the molar ratio of a silver iodide amount used in the preparation of outermost shells to a silver amount used in the preparation of these outermost shells. The distribution of the average silver iodide content can be either uniform or nonuniform. More preferably, the ratio of the outermost shell is 5 to 20 mol % of the total silver amount, and the average silver iodide content is 5 to 20 mol %.

The preparation of host tabular grains is basically the combination of three steps: nucleation, ripening, and growth.

In the nucleation step of grains used in the present invention, it is extremely effective to use gelatin having a small methionine content described in U.S. Pat. Nos. 4,713,320 and 4,942,120, perform nucleation at a high pBr described in U.S. Pat. No. 4,914,014, and perform nucleation within short time periods described in JP-A-2-222940. In the present invention, it is particularly preferable to perform stirring in the presence of low-molecular-weight, oxidization-processed gelatin at a temperature of 20° C. to 40° C. and add an aqueous silver nitrate solution, aqueous halogen solution, and low-molecular-weight, oxidization-processed gelatin within one minute. The pBr and pH of the system are preferably 2 or more and 7 or less, respectively. The concentration of an aqueous silver nitrate solution is 0.6 mol/liter or less. The use of this nucleation method facilitates the formation of perfect epitaxial tabular grains of the present invention.

The ripening step of a tabular grain emulsion of the present invention can be performed in the presence of a low-concentration base described in U.S. Pat. No. 5,254,453 or at a high pH described in U.S. Pat. No. 5,013,641. Polyalkylene oxide compounds described in U.S. Pat. Nos. 5,147,771, 5,147,772, 5,147,773, 5,171,659, 5,210,013, and 5,252,453 can be added in the ripening step or in the subsequent growth step. In the present invention, the ripening step is preferably performed at a temperature of 60° C. to 80° C. The pBr is preferably lowered to 2 or less immediately after nucleation or during ripening. Also, additional gelatin is preferably added during a period from the timing immediately after nucleation to the end of ripening. Particularly preferred gelatin is that 95% or more of an amino group are modified by succination or trimellitation. The use of this gelatin facilitates the preparation of perfect epitaxial tabular grains of the present invention.

In the growth step of the present invention, it is favorable to simultaneously add an aqueous silver nitrate solution, an aqueous halogen solution containing a bromide, and a silver iodide fine-grain emulsion described in U.S. Pat. Nos. 4,672,027 and 4,693,964. The silver iodide fine-grain emulsion substantially need only be silver iodide and can contain silver bromide and/or silver chloride as long as a mixed crystal can be formed. The emulsion is preferably 100% silver iodide. The crystal structure of silver iodide can be a β body, a γ body, or, as described in U.S. Pat. No. 4,672,026, an α body or an a body similar structure. In the present invention, the crystal structure is not particularly restricted but is preferably a mixture of β and γ bodies, and more preferably, a β body. The silver iodide fine-grain emulsion can be either an emulsion formed immediately before addition described in, e.g., U.S. Pat. No. 5,004,679 or an emulsion subjected to a regular washing step. In the present invention, an emulsion subjected to a regular washing step is preferably used. The silver iodide fine-grain emulsion can be readily formed by a method described in, e.g., U.S. Pat. No. 4,672,026. A double-jet addition method using an aqueous silver salt solution and an aqueous iodide salt solution in which grain formation is performed with a fixed pI value is preferred. The pI is the logarithm of the reciprocal of the $I^-$ ion concentration of the system. The temperature, pI, and pH of the system, the type and concentration of a protective colloid agent such as gelatin, and the presence/absence, type, and concentration of a silver halide solvent are not particularly limited. However, a grain size of preferably 0.1 μm or less, and more preferably, 0.07 μm or less is convenient for the present invention. Although the grain shapes cannot be perfectly specified because the grains are fine grains, the variation coefficient of a grain size distribution is preferably 25% or less. The effect of the present invention is particularly remarkable when the variation coefficient is 20% or less. The sizes and the size distribution of the silver iodide fine-grain emulsion are obtained by placing silver iodide fine grains on a mesh for electron microscopic observation and directly observing the grains by a transmission method instead of a carbon replica method. This is because measurement errors are increased by observation done by the carbon replica method since the grain sizes are small. The grain size is defined as the diameter of a circle having an area equal to the projected surface area of the observed grain. The grain size distribution also is obtained by using this equivalent-circle diameter of the projected surface area. In the present invention, the most effective silver iodide fine grains have a grain size of 0.06 to 0.02 μm and a grain size distribution variation coefficient of 18% or less.

After the grain formation described above, the silver iodide fine-grain emulsion is preferably subjected to regular washing described in, e.g., U.S. Pat. No. 2,614,929, and adjustments of the pH, the pI, the concentration of a protective colloid agent such as gelatin, and the concentration of the contained silver iodide are performed. The pH is preferably 5 to 7. The pI value is preferably the one at which the solubility of silver iodide is a minimum or the one higher than that value. As the protective colloid agent, a common gelatin having an average molecular weight of approximately 100,000 is preferably used. A low-molecular-weight gelatin having an average molecular weight of 20,000 or less also is favorably used. It is sometimes convenient to use a mixture of the gelatins having different molecular weights. The gelatin amount is preferably 10 to 100 g, and more preferably, 20 to 80 g per kg of an emulsion. The silver amount is preferably 10 to 100 g, and more preferably, 20 to 80 g, as the amount of silver atoms, per kg of an emulsion. The silver iodide fine-grain emulsion is usually dissolved before being added. During the addition it is necessary to sufficiently raise the efficiency of stirring of the system. The rotational speed of stirring is preferably set to be higher than usual. The addition of an antifoaming agent is effective to prevent the formation of foam during the stirring. More specifically, an antifoaming agent described in, e.g., examples of U.S. Pat. No. 5,275,929 is used.

A method described in JP-A-2-188741 is most preferably used in the growth step of the present invention. An ultrafine-grain emulsion of silver bromide, silver bromoiodide, or silver bromochloroiodide, which is prepared immediately before addition, is continuously added and dissolved during the growth of tabular grains, thereby growing the tabular grains. An external mixer for preparing the ultrafine-grain emulsion has high stirring power, and an aqueous silver nitrate solution, aqueous halogen solution, and gelatin are added to the mixer. Gelatin can be mixed in the aqueous silver nitrate solution and/or the aqueous halogen solution beforehand or immediately before the addition. Alternatively, an aqueous gelatin solution can be singly added. The molecular weight of gelatin is preferably smaller than usual, and particularly preferably, 10,000 to 50,000. It is particularly preferable to use gelatin in which an amino group is modified to 90% or more by phthalation, succination, or trimellitation and/or oxidization-processed gelatin whose methionine content is decreased. The use of this method allows easy preparation of perfect epitaxial tabular grains of the present invention.

In the present invention, 75% or less of all side faces connecting the opposing (111) major faces of a host tabular grain are particularly preferably constituted by (111) faces.

"175% or less of all side faces are constituted by (111) faces" means that crystallographic faces other than (111) faces exist at a ratio higher than 25% of all side faces. It is generally understood that this face is a (100) face, but some other face such as a (110) face or a higher-index face also can exist. The effect of the present invention is remarkable when 70% or less of all side faces are constituted by (111) faces.

Whether 70% or less of all side faces are constituted by (111) faces can be readily determined from a shadowed electron micrograph of the tabular grain obtained by a carbon replica method. When 75% or more of side faces are constituted by (111) faces in a hexagonal tabular grain, six side faces directly connecting to the (111) major faces alternately connect at acute and obtuse angles to the (111) major faces. On the other hand, when 70% or less of all side faces are constituted by (111) faces in a hexagonal tabular grain, all six side faces directly connecting to the (111) major faces connect at obtuse angles to the (111) major faces. By performing shadowing at an angle of 500 or less, it is possible to distinguish between obtuse and acute angles of side faces with respect to the major faces. Shadowing at an angle of preferably 100 to 300 facilitates distinguishing between obtuse and acute angles.

A method using adsorption of sensitizing dyes is also effective to obtain the ratio of (111) faces and (100) faces. The ratio of (111) faces and (100) faces can be quantitatively obtained by using a method described in Journal of Japan Chemical Society, 1984, Vol. 6, pp. 942 to 947. By using these ratios and the equivalent-circle diameter and thickness of a tabular grain, it is possible to calculate the ratio of (111) faces in all side faces. In this case it is assumed that a tabular grain is a circular cylinder by using the equivalent-circle diameter and thickness. On the basis of this assumption, the ratio of side faces to the total surface area can be obtained. The value obtained by dividing the ratio of (100) faces, which is obtained by adsorption of sensitizing dyes as described above, by the ratio of side faces and multiplying the quotient by 100 is the ratio of (100) faces in all side faces. By subtracting this value from 100, the ratio of (111) faces in all side faces can be calculated. In the present invention, the ratio of (111) faces in all side faces is more preferably 65% or less.

A method by which 75% or less of all side faces of the host tabular grain emulsion of the present invention are constituted by (111) faces will be described below. Most generally, the ratio of (111) faces in side faces of a host tabular grain emulsion can be determined by the pBr during the preparation of the tabular grain emulsion. The pBr is preferably so set that the ratio of (111) faces in side faces decreases, i.e., the ratio of (100) faces in side faces increases, during the addition of 30% or more of the silver amount required in the formation of outermost shells. More preferably, the pBr is so set that the ratio of (111) faces in side faces decreases during the addition of 50% or more of the silver amount necessary in the formation of outermost shells.

As another method, it is also possible to set, after the total silver amount is added, the pBr such that the ratio of (100) faces in side faces increases, and perform ripening to increase that ratio.

The value of the pBr by which the ratio of (100) faces in side faces increases can vary over a broad range in accordance with the temperature and pH of the system, the type and concentration of a protective colloid agent such as gelatin, and the presence/absence, type, and concentration of a silver halide solvent. Commonly, the pBr is preferably 2.0 to 5, and more preferably, 2.5 to 4.5. As described above, however, the value of the pBr can easily change owing to, e.g., the presence of a silver halide solvent. Examples of the silver halide solvent usable in the present invention are (a) organic thioethers described in, e.g., U.S. Pat. Nos. 3,271,157, 3,531,286, and 3,574,628, and JP-A's-54-1019 and 54-158917, (b) thiourea derivatives described in, e.g., JP-A's-53-82408, 55-77737, and 55-2982, (c) a silver halide solvent having a thiocarbonyl group sandwiched between an oxygen or sulfur atom and a nitrogen atom described in JP-A-53-144319, (d) imidazoles described in JP-A-54-100717, (e) sulfite, (f) ammonia, and (g) thiocyanate.

Particularly preferred solvents are thiocyanate, ammonia, and tetramethylthiourea. Although the amount of a solvent used changes in accordance with the type of the solvent, a preferred amount of, e.g., thiocyanate is $1\times10^{-4}$ to $1\times10^{-2}$ mol per mol of a silver halide.

EP515894A1 and the like can be referred to as a method of changing the face index of a side face of a tabular grain emulsion. Also, polyalkyleneoxide compounds described in, e.g., U.S. Pat. No. 5,252,453 can be used. It is effective to use face index modifiers described in, e.g., U.S. Pat. Nos. 4,680,254, 4,680,255, 4,680,256, and 4,684,607. Common photographic spectral sensitizing dyes also can be used as face index modifiers.

In the present invention, host tabular grains preferably do not have dislocation lines. Dislocation lines can be vanished by using the combination of the nucleation, ripening, and growth steps described above.

Details of epitaxial junctions necessary for the preparation of perfect epitaxial tabular grains of the present invention will be described below. Epitaxial deposition can be performed immediately after the formation of host tabular grains or after regular desalting is performed after the formation of host tabular grains. Preferably, epitaxial deposition is performed after common desalting is performed. A host tabular grain emulsion of the present invention is preferably washed with water for desalting and -dispersed in a newly prepared protective colloid. It is advantageous to use gelatin as the protective colloid for dispersing the desalted host tabular grain emulsion of the present invention. The most preferred gelatin is high-molecular-weight gelatin formed by crosslinking common gelatin by a chemical method. This gelatin further stabilizes perfect epitaxial tabular grains of the present invention. However, another hydrophilic colloid can also be used.

Examples of the hydrophilic colloid are protein, such as a gelatin derivative, a graft polymer of gelatin and another high polymer, albumin, and casein; sugar derivatives, such as cellulose derivatives, e.g., cellulose sulfates, hydroxyethylcellulose, and carboxymethylcellulose, soda alginate, and starch derivatives; and a variety of synthetic hydrophilic high polymers, such as homopolymers or copolymers, e.g., polyvinyl alcohol, polyvinyl alcohol partial acetal, poly-N-vinylpyrrolidone, polyacrylic acid, polymethacrylic acid, polyacrylamide, polyvinylimidazole, and polyvinylpyrazole. Examples of gelatin are lime-processed gelatin, acid-processed gelatin, and enzyme-processed gelatin described in Bull. Soc. Sci. Photo. Japan. No. 16, page 30 (1966). In addition, a hydrolyzed product or an enzyme-decomposed product of gelatin can also be used.

Although the temperature of washing can be selected in accordance with the intended use, it is preferably 5° C. to 50° C. Although the pH of washing can also be selected in accordance with the intended use, it is preferably 2 to 10, and more preferably, 3 to 8. The pAg of washing is preferably 5 to 10, though it can also be selected in accordance with the intended use. The washing method can be selected from noodle washing, dialysis using a semipermeable membrane, centrifugal separation, coagulation precipitation, and ion exchange. The coagulation precipitation can be selected from a method using sulfate, method using an organic solvent, method using a water-soluble polymer, and method using a gelatin derivative.

During dispersion after desalting, the pH, pAg, type and concentration of gelatin, and viscosity are chosen to prepare perfect epitaxial tabular grains of the present invention. The gelatin concentration is particularly important and preferably 50 g or more per liter. The gelatin concentration is particularly preferably 70 to 120 g. If the gelatin concentration is too low, epitaxial deposition occurs on the major surfaces of tabular grains. If the gelatin concentration is too high, the viscosity rises to cause nonuniform epitaxial deposition between grains.

A sensitizing dye is used as a site director for an epitaxial junction of the present invention. The deposition position of epitaxial can be controlled by the selection of the amount and type of dye used. The addition amount of dye is preferably 50% to 90% of a saturated covering amount. Usable dyes involve a cyanine dye, merocyanine dye, composite cyanine dye, composite merocyanine dye, holopolar cyanine dye, hemicyanine dye, styryl dye, and hemioxonole dye. Most useful dyes are those belonging to a cyanine dye. Any nucleus commonly used as a basic heterocyclic nucleus in cyanine dyes can be applied to these dyes. Examples of an applicable nucleus are a pyrroline nucleus, oxazoline nucleus, thiozoline nucleus, pyrrole nucleus, oxazole nucleus, thiazole nucleus, selenazole nucleus, imidazole nucleus, tetrazole nucleus, and pyridine nucleus; a nucleus in which an aliphatic hydrocarbon ring is fused to any of the above nuclei; and a nucleus in which an aromatic hydrocarbon ring is fused to any of the above nuclei, e.g., an indolenine nucleus, benzindolenine nucleus, indole nucleus, benzoxadole nucleus, naphthoxazole nucleus, benzthiazole nucleus, naphthothiazole nucleus, benzoselenazole nucleus, benzimidazole nucleus, and quinoline nucleus. These nuclei can have a substituent on a carbon atom.

Although these sensitizing dyes can be used singly, they can also be used together. The combination of sensitizing dyes is often used for a supersensitization purpose. Representative examples of the combination are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Patent Nos. 1,344,281 and 1,507,803, Jpn. Pat. Appln. KOKOKU Publication No. (hereinafter referred to as JP-B-)43-4936 and JP-B-53-12375, and JP-A's-52-110618 and 52-109925.

In addition to the sensitizing dyes, dyes having no spectral sensitizing effect or substances not substantially absorbing visible light and presenting supersensitization can be simultaneously or separately added.

Raising the silver iodide content of the surface composition of host tabular grains during the adsorption of sensitizing dyes is favorable for the preparation of perfect epitaxial tabular grains. Iodine ions are added before the addition of sensitizing dyes. In the present invention, it is most preferable to raise the silver iodide content on the surface of a host tabular grain by adding the aforementioned AgI fine-grain emulsion. This makes the silver iodide content distribution between grains uniform and the adsorption of sensitizing dyes uniform, thereby making the preparation of perfect epitaxial tabular grains feasible. The addition amount of iodine ions or silver iodide is preferably $1\times10^{-4}$ to $1\times10^{-2}$ mol, and particularly preferably, $1\times10^{-3}$ to $5\times10^{-3}$ mol with respect to host tabular grains.

Epitaxial portions can be formed by simultaneously or separately adding a solution containing halogen ions and a solution containing $AgNO_3$. Epitaxial portions can also be formed by properly combining the addition of fine AgCl, AgBr, or AgI grains smaller than host tabular grains, or the addition of mixed-crystal grains of these grains. When an $AgNO_3$ solution is added, the addition time is preferably 30 sec to 10 min, and particularly preferably, 1 to 5 min. To form perfect epitaxial tabular grains of the present invention, the concentration of a silver nitrate solution to be added is preferably 1.5 mol/liter or less, and particularly preferably, 0.5 mol/liter or less. During the addition, stirring in the system must be efficiently performed, and the viscosity of the system is preferably as low as possible.

The silver amount of an epitaxial portion is preferably 0.5 to 10 mol %, and more preferably, 1 to 5 mol % of the silver amount of a host tabular grain. If the silver amount of an epitaxial portion is too small, no perfect epitaxial tabular grains can be prepared. If the silver amount is too large, the preparation becomes unstable.

During the formation of an epitaxial portion, the pBr is preferably 3.5 or more, and particularly preferably, 4.0 or more. The temperature is favorably 35° C. to 45° C. During the formation of this epitaxial portion, a hexacyano metal complex is preferably doped.

This hexacyano metal complex desirably contains iron, ruthenium, osmium, cobalt, rhodium, iridium, or chromium. The addition amount of the metal complex is preferably $10^{-9}$ to $10^{-2}$ mol, and more preferably, $10^{-8}$ to $10^{-4}$ mol per mol of a silver halide. The metal complex can be added by dissolving it in water or an organic solvent. This organic solvent is preferably miscible in water. Examples of the organic solvent are alcohols, ethers, glycols, ketones, esters, and amides.

The metal complex is particularly preferably a hexacyano metal complex represented by formula (I) below. This hexacyano metal complex has effects of obtaining a high-speed sensitive material and suppressing the generation of fog even when a raw sensitive material is stored for long time periods.

$$[M(CN)_6]^{n-} \quad (I)$$

(wherein M represents iron, ruthenium, osmium, cobalt, rhodium, iridium, or chromium, and n represents 3 or 4.)

Practical examples of the hexacyano metal complex are presented below.

| | |
|---|---|
| (I-1) | $[Fe(CN)_6]^{4-}$ |
| (I-2) | $[Fe(CN)_6]^{3-}$ |
| (I-3) | $[Ru(CN)_6]^{4-}$ |
| (I-4) | $[Os(CN)_6]^{4-}$ |
| (I-5) | $[Co(CN)_6]^{3-}$ |
| (I-6) | $[Rh(CN)_6]^{3-}$ |
| (I-7) | $[Ir(CN)_6]^{3-}$ |
| (I-8) | $[Cr(CN)_6]^{4-}$ |

As a counter cation of a hexacyano complex, it is preferable to use an ion which is readily miscible in water and suited to precipitation of a silver halide emulsion. Examples of a counter ion include alkali metal ions (e.g., sodium ion, potassium ion, rubidium ion, cesium ion, and lithium ion), ammonium ion, and alkylammonium ion.

After epitaxial deposition, it is favorable to add to an emulsion of the present invention the sensitizing dyes described above and/or antifoggants and/or stabilizers to be described later.

In the present invention, the pBr is preferably lowered after that. In epitaxial emulsions outside the range of the present invention, epitaxial is destroyed by this lowering of the pBr, and the photographic sensitivity lowers. In an emulsion of the present invention, which contains perfect epitaxial tabular grains at a ratio of 70% or more of the total projected area, this lowering of the pBr is possible, and this achieves remarkable effects in storage stability and processability. Preferably, the pBr at 40° C. is lowered to 3.5 or less. The pBr at 40° C. of an emulsion of the present invention is more preferably 3.0 or less, and particularly preferably, 2.5 or less. The pBr is basically lowered by adding bromine ion such as KBr or NaBr.

An emulsion of the present invention is preferably chemically sensitized after epitaxial deposition. One chemical sensitization which can be preferably performed in the present invention is chalcogen sensitization, noble metal sensitization, or the combination of these. Chemical sensitization can be performed by using an active gelatin as described in T. H. James, The Theory of the Photographic Process, 4th ed., Macmillan, 1977, pp. 67 to 76. Chemical sensitization can also be performed by using any of sulfur, selenium, tellurium, gold, platinum, palladium, and iridium, or by using the combination of a plurality of these sensitizers at pAg 5 to 10, pH 5 to 8, and a temperature of 30 to 80° C., as described in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent No. 1,315,755. In noble metal sensitization, salts of noble metals, such as gold, platinum, palladium, and iridium, can be used. In particular, gold sensitization, palladium sensitization, or the combination of the two is preferred. In gold sensitization, it is possible to use known compounds, such as chloroauric acid, potassium chloroaurate, potassium aurithiocyanate, gold sulfide, and gold selenide. A palladium compound means a divalent or tetravalent salt of palladium. A preferred palladium compound is represented by $R_2PdX_6$ or $R_2PdX_4$ wherein R represents a hydrogen atom, an alkali metal atom, or an ammonium group and X represents a halogen atom, i.e., a chlorine, bromine, or iodine atom.

More specifically, the palladium compound is preferably $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. The gold compound and the palladium compound are preferably used in combination with thiocyanate or selenocyanate.

Examples of a sulfur sensitizer are hypo, a thiourea-based compound, a rhodanine-based compound, and sulfur-containing compounds described in U.S. Pat. Nos. 3,857,711, 4,266,018, and 4,054,457. Chemical sensitization can also be performed in the presence of a so-called chemical sensitization aid. Examples of a useful chemical sensitization aid are compounds, such as azaindene, azapyridazine, and azapyrimidine, which are known as compounds capable of suppressing fog and increasing sensitivity in the process of chemical sensitization. Examples of a modifier of the chemical sensitization aid are described in U.S. Pat. Nos. 2,131,038, 3,411,914, and 3,554,757, JP-A-58-126526, and G. F. Duffin, Photographic Emulsion Chemistry, pp. 138 to 143.

It is preferable to also perform gold sensitization for emulsions of the present invention. The amount of a gold sensitizer is preferably $1\times10^{-4}$ to $1\times10^{-7}$ mol, and more preferably, $1\times10^{-5}$ to $5\times10^{-7}$ mol per mol of a silver halide. A preferred amount of a palladium compound is $1\times10^{-3}$ to $5\times10^{-7}$ mol per mol of a silver halide. A preferred amount of a thiocyan compound or a selenocyan compound is $5\times10^{-2}$ to $1\times10^{-6}$ mol per mol of a silver halide.

The amount of sulfur sensitizer used in silver halide grains in emulsions of the present invention is preferably $1\times10^{-4}$ to $1\times10^{-7}$ mol, and more preferably, $1\times10^{-5}$ to $5\times10^{-7}$ mol per mol of a silver halide.

Selenium sensitization is a preferred sensitizing method for emulsions of the present invention. Known labile selenium compounds are used in selenium sensitization. Practical examples of the selenium compound are colloidal metal selenium, selenoureas (e.g., N,N-dimethylselenourea and N,N-diethylselenourea), selenoketones, and selenoamides.

It is sometimes favorable to perform selenium sensitization in combination with one or both of sulfur sensitization and noble metal sensitization.

Labile tellurium compounds are used in tellurium sensitization. It is possible-to use labile tellurium compounds described in, e.g., JP-A's-4-224595, 4-271341, 4-333043, 5-303157, 6-27573, 6-175258, 6-180478, 6-208184, 6-208186, 6-317867, 7-140579, 7-301879, and 7-301880.

More specifically, it is possible to use phosphinetellurides (e.g., normalbutyl-diisopropylphosphinetelluride, triisobutylphosphinetelluride, trinormalbutoxyphosphinetelluride, and triisopropylphosphinetelluride), diacyl(di)tellurides (e.g., bis(diphenylcarbamoyl)ditelluride, bis(N-phenyl-N-methylcarbamoyl)ditelluride, bis(N-phenyl-N-methylcarbamoyl)telluride, bis(N-phenyl-N-benzylcarbamoyl)telluride, and bis(ethoxycarbonyl)telluride), telluroureas (e.g., N,N'-dimethylethylenetellurourea), telluroamides, and telluroesters. Preferred compounds are phosphinetellurides and diacyl(di)tellurides.

Photographic emulsions used in the present invention can contain various compounds in order to prevent fog during the manufacturing process, storage, or photographic processing of a sensitive material, or to stabilize photographic properties. That is, it is possible to add many compounds known as antifoggants or stabilizers, e.g., thiazoles such as benzothiazolium salt, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; a thioketo compound such as oxadolinethione; and azaindenes such as triazaindenes, tetrazaindenes (particularly 4-hydroxy-substituted(1,3,3a,7)tetrazaindenes), and pentazaindenes. For example, compounds described in U.S. Pat. Nos. 3,954,474 and 3,982,947 and JP-B-52-28660 can be used. One preferred compound is described in JP-A-63-212932. Antifoggants and stabilizers can be added at any of several different timings, such as before, during, and after grain formation, during washing with water, during dispersion after the washing, during epitaxial formation, before, during, and after chemical sensitization, and before coating, in accordance with the intended application. The antifoggants and stabilizers can be added during preparation of an emulsion to achieve their original fog preventing effect and stabilizing effect. In addition, the antifoggants and stabilizers can be used for various purposes of, e.g., controlling the crystal habit of grains, decreasing the grain size, decreasing the solubility of grains, controlling chemical sensitization, and controlling the arrangement of dyes.

In the preparation of an emulsion of the present invention, it is favorable to make salt of metal ion exist during grain formation, desalting, epitaxial formation, or chemical sensitization, or before coating in accordance with the intended use. The metal ion salt is preferably added during grain formation when doped into grains, and after grain formation and before completion of chemical sensitization when used to modify the grain surface or used as a chemical sensitizer. The doping can be performed for any of an overall grain, or only the core or the shell of a grain. Examples of the metal are Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi. These metals can be added as long as they are in the form of salt that can be dissolved during grain formation, such as ammonium salt, acetate, nitrate, sulfate, phosphate, hydroxide salt, 6-coordinated complex salt, or 4-coordinated complex salt. Examples are $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, and $K_4Ru(CN)_6$. The ligand of a coordination compound can be selected from halo, aquo, cyano, cyanate, thiocyanate, nitrosyl, thionitrosyl, oxo, and carbonyl. These metal compounds can be used either singly or in the form of the combination of two or more types of them.

The metal compounds are favorably dissolved in water or an appropriate organic solvent, such as methanol or acetone, and added in the form of a solution. To stabilize the solution, an aqueous halogenated hydrogen solution (e.g., HCl and HBr) or an alkali halide (e.g., KCl, NaCl, Kbr, and NaBr) can be added. It is also possible to add acid or alkali if necessary. The metal compounds can be added to a reactor vessel either before or during grain formation. Alternatively, the metal compounds can be added to a water-soluble silver salt (e.g., $AgNO_3$) or an aqueous alkali halide solution (e.g., NaCl, KBr, and KI) and continuously added in the form of a solution during formation of silver halide grains. Furthermore, a solution of the metal compounds can be prepared independently of a water-soluble silver salt or an alkali halide and continuously added at a proper timing during grain formation. It is also preferable to combine several different addition methods.

Silver halide photographic emulsions of the present invention are preferably subjected to reduction sensitization during grain formation, after grain formation and before or during chemical sensitization, or after chemical sensitization.

The reduction sensitization can be selected from a method of adding reduction sensitizers to a silver halide emulsion, a method called silver ripening in which grains are grown or ripened in an atmosphere of low-pAg at pAg 1 to 7, and a method called high-pH ripening in which grains are grown or ripened in an atmosphere of high-pH at pH 8 to 11. Two or more of these methods can also be used together.

The method of adding reduction sensitizers is preferable in that the level of reduction sensitization can be finely adjusted.

Known examples of the reduction sensitizer are stannous salt, ascorbic acid and its derivative, amines and polyamines, a hydrazine derivative, formamidinesulfinic acid, a silane compound, and a borane compound. In the reduction sensitization used in the present invention, it is possible to selectively use these known reduction sensitizers or to use two or more types of compounds together. Preferred compounds as the reduction sensitizer are stannous chloride, thiourea dioxide, dimethylamineborane, and ascorbic acid and its derivative. Although the addition amount of the reduction sensitizers must be so selected as to meet the emulsion manufacturing conditions, a preferred amount is $10^{-7}$ to $10^{-3}$ mol per mol of a silver halide.

The reduction sensitizers are dissolved in water or an organic solvent, such as alcohols, glycols, ketones, esters, or amides, and the resultant solution is added during grain growth. Although adding to a reactor vessel in advance is also preferable, adding at a proper timing during grain growth is more preferable. It is also possible to add the reduction sensitizers to an aqueous solution of a water-soluble silver salt or a water-soluble alkali halide to precipitate silver halide grains by using this aqueous solution. Alternatively, a solution of the reduction sensitizers can be added separately several times or continuously over a long time period with grain growth.

It is favorable to use an oxidizer for silver during the process of manufacturing emulsions of the present invention. The oxidizer for silver means a compound having an effect of converting metal silver into silver ion. A particularly effective compound is the one that converts very fine silver grains, as a by-product in the process of formation of silver halide grains and chemical sensitization, into silver ions. The silver ions produced can form a silver salt hard to dissolve in water, such as a silver halide, silver sulfide, or silver selenide, or a silver salt easy to dissolve in water, such as silver nitrate. The oxidizer for silver can be either an inorganic or organic substance. Examples of the inorganic oxidizer are ozone, hydrogen peroxide and its adduct (e.g., $NaBO_2.H_2O_2.3H_2O$, $2NaCO_3.3H_2O_2$, $Na_4P_2O_7.2H_2O_2$, and $2Na_2SO_4.H_2O_2.2H_2O$), peroxy acid salt (e.g., $K_2S_2O_8$, $K_2C_2O_6$, and $K_2P_2O_8$), a peroxy complex compound (e.g., $K_2[Ti(O_2)C_2O_4].3H_2O$, $4K_2SO_4.Ti(O_2)OH.SO_4.2H_2O$, and $Na_3[VO(O_2)(C_2H_4)_2.6H_2O]$, permanganate (e.g., $KMnO_4$), an oxyacid salt such as chromate (e.g., $K_2Cr_2O_7$), a halogen element such as iodine and bromine, perhalogenate (e.g., potassium periodate), a salt of a high-valence metal (e.g., potassium hexacyanoferrate(II)), and thiosulfonate.

Examples of the organic oxidizer are quinones such as p-quinone, an organic peroxide such as peracetic acid and perbenzoic acid, and a compound to release active halogen (e.g., N-bromosuccinimide, chloramine T, and chloramine B).

Preferred oxidizers used in the present invention are inorganic oxidizers of ozone, hydrogen peroxide and its adduct, a halogen element and thiosulfonate, and an organic oxidizer of quinones. A combination of the reduction sensitization described above and the oxidizer for silver is preferable. In this case, the reduction sensitization can be performed after the oxidizer is used or vice versa, or the reduction sensitization and the addition of the oxidizer can be performed at the same time. These methods can be selectively performed during grain formation or chemical sensitization.

In a sensitive material of the present invention, at least one sensitive layer need only be formed on a support. A typical example is a silver halide photographic lightsensitive material having, on a support, at least one sensitive layer consisting of a plurality of silver halide emulsion layers sensitive to substantially the same color but different in sensitivity. This sensitive layer is a unit sensitive layer sensitive to one of blue light, green light, and red light. In a multilayered silver halide color photographic lightsensitive material, sensitive layers are generally arranged in the order of red-, green-, and blue-sensitive layers from a support. However, according to the intended use, this order of arrangement can be reversed, or sensitive layers sensitive to the same color can sandwich another sensitive layer sensitive to a different color. Non-sensitive layers can be formed between the silver halide sensitive layers and as the uppermost layer and the lowermost layer. These non-sensitive layers can contain, e.g., couplers, DIR compounds, and color amalgamation inhibitors to be described later. As a plurality of silver halide emulsion layers constituting each unit sensitive layer, as described in DE1,121,470 or GB923,045, the disclosures of which are incorporated herein by reference, high- and low-speed emulsion layers are preferably arranged such that the sensitivity is sequentially decreased toward a support. Also, as described in JP-A's-57-112751, 62-200350, 62-206541, and 62-206543, the disclosures of which are incorporated herein by reference, layers can be arranged such that a low-speed emulsion layer is formed apart from a support and a high-speed layer is formed close to the support.

More specifically, layers can be arranged, from the one farthest from a support, in the order of a low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL, or the order of BH/BL/GH/GL/RL/RH.

In addition, as described in JP-B-55-34932, the disclosure of which is incorporated herein by reference, layers can be arranged in the order of a blue-sensitive layer/GH/RH/GL/RL from the one farthest from a support. Furthermore, as described in JP-A's-56-25738 and 62-63936, the disclosures of which are incorporated herein by reference, layers can be arranged in the order of a blue-sensitive layer/GL/RL/GH/RH from the one farthest from a support.

As described in JP-B-49-15495, the disclosure of which is incorporated herein by reference, three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer, i.e., three layers having different sensitivities can be arranged such that the sensitivity is sequentially decreased toward a support. When the layer structure is thus constituted by three layers having different sensitivities, these three layers can be arranged, in the same color-sensitive layer, in the order of a medium-speed emulsion layer/high-speed emulsion layer/low-speed emulsion layer from the one farthest from a support as described in JP-A-59-202464, the disclosure of which is incorporated herein by reference.

In addition, the order of a high-speed emulsion layer/low-speed emulsion layer/medium-speed emulsion layer or low-speed emulsion layer/medium-speed emulsion layer/high-speed emulsion layer can be used. Furthermore, the arrangement can be changed as described above even when four or more layers are formed.

To improve the color reproducibility, as described in U.S. Pat. Nos. 4,663,271, 4,705,744, 4,707,436, and JP-A's-62-160448 and 63-89850, the disclosures of which are incorporated herein by reference, a donor layer (CL) with an interlayer effect, which has a different spectral sensitivity distribution from that of a main sensitive layer such as BL, GL, or RL, is preferably formed adjacent to, or close to, this main sensitive layer.

A silver halide photographic lightsensitive material of the present invention need only has at least one sensitive layer containing an emulsion of the present invention. Also, the effects of the present invention are achieved regardless of a sensitive layer containing an emulsion of the present invention.

An emulsion except an emulsion of the present invention, which is used in a sensitive material of the present invention, are detailed below. A silver halide used in an emulsion except an emulsion of the present invention is preferably silver iodobromide, silver iodochloride, or silver bromochloroiodide containing about 30 mol % or less of silver iodide. A silver halide is most preferably silver iodobromide or silver bromochloroiodide containing about 2 to about 10 mol % of silver iodide.

Silver halide grains contained in a photographic emulsion can have regular crystals such as cubic, octahedral, or tetradecahedral crystals, irregular crystals such as spherical or tabular crystals, crystals having crystal defects such as twin planes, or composite shapes thereof.

A silver halide can consist of fine grains having a grain size of about 0.2 μm or less or large grains having a projected area diameter of about 10 μm, and an emulsion can be either a polydisperse or monodisperse emulsion.

A silver halide photographic emulsion usable in the present invention can be prepared by methods described in, e.g., "I. Emulsion preparation and types," Research Disclosure (RD) No. 17643 (December, 1978), pp. 22 and 23, RD No. 18716 (November, 1979), p. 648, and RD No. 307105 (November, 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964, the disclosures of which are incorporated herein by reference.

Monodisperse emulsions described in, e.g., U.S. Pat. Nos. 3,574,628, 3,655,394, and GB1,413,748 are also favorable, the disclosures of which are incorporated herein by reference.

Tabular grains having an aspect ratio of 3 or more can also be used in the present invention. Tabular grains can be easily prepared by methods described in Gutoff, "Photographic Science and Engineering", Vol. 14, pp. 248 to 257 (1970); and U.S. Pat. Nos. 4,434,226, 4,414,310, 4,433,048, 4,439,520, and GB2,112,157, the disclosures of which are incorporated herein by reference.

A crystal structure can be uniform, can have different halogen compositions in the interior and the surface layer thereof, or can be a layered structure. Alternatively, a silver halide having a different composition can be bonded by an epitaxial junction, or a compound except for a silver halide such as silver rhodanide or lead oxide can be bonded. A mixture of grains having various types of crystal shapes can also be used.

The above emulsion can be any of a surface latent image type emulsion which mainly forms a latent image on the surface of a grain, an internal latent image type emulsion which forms a latent image in the interior of a grain, and another type of emulsion which has latent images on the surface and in the interior of a grain. However, the emulsion must be a negative type emulsion. The internal latent image type emulsion can be a core/shell internal latent image type emulsion described in JP-A-63-264740, the disclosure of which is incorporated herein by reference. A method of preparing this core/shell internal latent image type emulsion is described in JP-A-59-133542, the disclosure of which is incorporated herein by reference. Although the thickness of a shell of this emulsion depends on the development conditions and the like, it is preferably 3 to 40 nm, and most preferably, 5 to 20 nm.

A silver halide emulsion is normally subjected to physical ripening, chemical ripening, and spectral sensitization steps before it is used. Additives for use in these steps are described in RD Nos. 17643, 18716, and 307105, the disclosures of which are incorporated herein by reference, and they are summarized in a table to be presented later.

In a sensitive material of the present invention, it is possible to mix, in the same layer, two or more types of emulsions different in at least one of the characteristics, i.e., the grain size, grain size distribution, halogen composition, grain shape, and sensitivity, of a sensitive silver halide emulsion.

It is also possible to preferably use surface-fogged silver halide grains described in U.S. Pat. No. 4,082,553, internally fogged silver halide grains described in U.S. Pat. No. 4,626,498 and JP-A-59-214852, and colloidal silver, in sensitive silver halide emulsion layers and/or substantially non-sensitive hydrophilic colloid layers, all the disclosures of which are incorporated herein by reference. The internally fogged or surface-fogged silver halide grain means a silver halide grain which can be developed uniformly (non-imagewise) regardless of whether the location is a non-exposed portion or an exposed portion of the sensitive material. A method of preparing the internally fogged or surface-fogged silver halide grain is described in U.S. Pat. No. 4,626,498 and JP-A-59-214852, the disclosures of which are incorporated herein by reference. A silver halide which forms the core of an internally fogged core/shell type silver halide grain can have a different halogen composition. As the internally fogged or surface-fogged silver halide, any of silver chloride, silver chlorobromide, silver bromoiodide, and silver bromochloroiodide can be used. The average grain size of these fogged silver halide grains is preferably 0.01 to 0.75 μm, and most preferably, 0.05 to 0.6 μm. The grain shape can be a regular grain shape. Although the emulsion can be a polydisperse emulsion, it is preferably a monodisperse emulsion (in which at least 95% in weight or number of grains of silver halide grains have grain sizes falling within the range of ±40% of the average grain size).

In the present invention, it is preferable to use a non-sensitive fine grain silver halide. The non-sensitive fine grain silver halide preferably consists of silver halide grains which are not exposed during imagewise exposure for obtaining a dye image and are not substantially developed during development. These silver halide grains are preferably not fogged in advance. In the fine grain silver halide, the content of silver bromide is 0 to 100 mol %, and silver chloride and/or silver iodide can be added if necessary. The fine grain silver halide preferably contains 0.5 to 10 mol % of silver iodide. The average grain size (the average value of the equivalent-circle diameters of projected areas) of the fine grain silver halide is preferably 0.01 to 0.5 μm, and more preferably, 0.02 to 2 μm.

The fine grain silver halide can be prepared following the same procedures as for a common sensitive silver halide. The surface of each silver halide grain need not be optically sensitized nor spectrally sensitized. However, before the silver halide grains are added to a coating solution, it is preferable to add a well-known stabilizer such as a triazole-based compound, azaindene-based compound, benzothiazolium-based compound, mercapto-based compound, or zinc compound. Colloidal silver can be added to this fine grain silver halide grain-containing layer.

The silver coating amount of a sensitive material of the present invention is preferably 6.0 g/m$^2$ or less, and most preferably, 4.5 g/m$^2$ or less.

Photographic additives usable in the present invention are also described in the following RDs, the disclosures of which are incorporated herein by reference, and the relevant portions are summarized in the following table.

| Additives | RD17643 | RD18716 | RD307105 |
|---|---|---|---|
| 1. Chemical sensitizers | page 23 | page 648, right column | page 866 |
| 2. Sensitivity increasing agents | | do | |
| 3. Spectral sensitizers, super sensitizers | pages 23-24 | page 648, right column to page 649, right column | pages 866-868 |
| 4. Brighteners | page 24 | page 647, right column | page 868 |

-continued

| Additives | RD17643 | RD18716 | RD307105 |
|---|---|---|---|
| 5. Light absorbents, filter dyes, ultraviolet absorbents | pages 25-26 | page 649, right column to page 650, left column | page 873 |
| 6. Binders | page 26 | page 651, left column | pages 873-874 |
| 7. Plasticizers, lubricants | page 27 | page 650, right column | page 876 |
| 8. Coating aids, surface active agents | pages 26-27 | do | pages 875-876 |
| 9. Antistatic agents | page 27 | do | pages 876-877 |
| 10. Matting agents | | | pages 878-879 |

Various dye forming couplers can be used in a sensitive material of the present invention, and the following couplers are particularly preferable.

Yellow couplers: couplers represented by formulas (I) and (II) in EP502,424A; couplers (particularly Y-28 on page 18) represented by formulas (1) and (2) in EP513,496A; a coupler represented by formula (I) in claim 1 of EP568,037A; a coupler represented by formula (I) in column 1, lines 45 to 55 of U.S. Pat. No. 5,066,576; a coupler represented by formula (I) in paragraph 0008 of JP-A-4-274425; couplers (particularly D-35 on page 18) described in claim 1 on page 40 of EP498,381A1; couplers (particularly Y-1 (page 17) and Y-54 (page 41)) represented by formula (Y) on page 4 of EP447,969A1; and couplers (particularly II-17 and II-19 (column 17), and II-24 (column 19)) represented by formulas (II) to (IV) in column 7, lines 36 to 58 of U.S. Pat. No. 4,476,219, all the disclosures of which are incorporated herein by reference.

Magenta couplers: JP-A-3-39737 (L-57 (page 11, lower right column), L-68 (page 12, lower right column), and L-77 (page 13, lower right column); [A-4]-63 (page 134), and [A-4]-73 and [A-4]-75 (page 139) in EP456,257; M-4 and M-6 (page 26), and M-7 (page 27) in EP486,965; M-45 (page 19) in EP571,959A; (M-1) (page 6) in JP-A-5-204106; and M-22 in paragraph 0237 of JP-A-4-362631, all the disclosures of which are incorporated herein by reference.

Cyan couplers: CX-1, CX-3, CX-4, CX-5, CX-11, CX-12, CX-14, and CX-15 (pages 14 to 16) in JP-A-4-204843; C-7 and C-10 (page 35), C-34 and C-35 (page 37), and (I-1) and (I-17) (pages 42 and 43) in JP-A-4-43345; and couplers represented by formulas (Ia) and (Ib) in claim 1 of JP-A-6-67385, all the disclosures of which are incorporated herein by reference.

Polymer couplers: P-1 and P-5 (page 11) in JP-A-2-44345, the disclosure of which is incorporated herein by reference.

Couplers for forming a colored dye with proper diffusibility are preferably those described in U.S. Pat. No. 4,366,237, GB2,125,570, EP96,873B, and DE3,234,533, the disclosures of which are incorporated herein by reference.

Couplers for correcting unnecessary absorption of a colored dye are preferably yellow colored cyan couplers (particularly YC-86 on page 84) represented by formulas (CI), (CII), (CIII), and (CIV) described on page 5 of EP456,257A1; yellow colored magenta couplers ExM-7 (page 202), EX-1 (page 249), and EX-7 (page 251) described in EP456,257A1; magenta colored cyan couplers CC-9 (column 8) and CC-13 (column 10) described in U.S. Pat. No. 4,833,069; (2) (column 8) in U.S. Pat. No. 4,837,136; and colorless masking couplers (particularly compound examples on pages 36 to 45) represented by formula (A) in claim 1 of WO92/11575, all the disclosures of which are incorporated herein by reference.

Examples of a compound which releases a photo-graphically useful group are as follows. Development inhibitor release compounds: compounds (particularly T-101 (page 30), T-104 (page 31), T-113 (page 36), T-131 (page 45), T-144 (page 51), and T-158 (page 58)) represented by formulas (I), (II), (III), (IV) described on page 11 of EP378,236A1, compounds (particularly D-49 (page 51)) represented by formula (I) described on page 7 of EP436,938A2, compounds (particularly (23) (page 11)) represented by formula (1) in EP568,037A, and compounds (particularly I-(1) on page 29) represented by formulas (I), (II), and (III) described on pages 5 and 6 of EP440,195A2; bleaching accelerator release compounds: compounds (particularly (60) and (61) on page 61) represented by formulas (I) and (I') on page 5 of EP310,125A2, and compounds (particularly (7) (page 7)) represented by formula (I) in claim 1 of JP-A-6-59411; ligand release compounds: compounds (particularly compounds in column 12, lines 21 to 41) represented by LIG-X described in claim 1 of U.S. Pat. No. 4,555,478; leuco dye release compounds: compounds 1 to 6 in columns 3 to 8 of U.S. Pat. No. 4,749,641; fluorescent dye release compounds: compounds (particularly compounds 1 to 11 in columns 7 to 10) represented by COUP-DYE in claim 1 of U.S. Pat. No. 4,774,181; development accelerator or fogging agent release compounds: compounds (particularly (I-22) in column 25) represented by formulas (1), (2), and (3) in column 3 of U.S. Pat. No. 4,656,123, and ExZK-2 on page 75, lines 36 to 38 of EP450,637A2; compounds which release a group which does not function as a dye unless it splits off: compounds (particularly Y-1 to Y-19 in columns 25 to 36) represented by formula (I) in claim 1 of U.S. Pat. No. 4,857,447, all the disclosures of which are incorporated herein by reference.

Preferred examples of additives other than couplers are as follows.

Dispersants of an oil-soluble organic compound: P-3, P-5, P-16, P-19, P-25, P-30, P-42, P-49, P-54, P-55, P-66, P-81, P-85, P-86, and P-93 (pages 140 to 144) in JP-A-62-215272; impregnating latexes of an oil-soluble organic compound: latexes described in U.S. Pat. No. 4,199,363; developing agent oxidized form scavengers: compounds (particularly I-(1), I-(2), I-(6), and I-(12) (columns 4 and 5)) represented by formula (I) in column 2, lines 54 to 62 of U.S. Pat. No. 4,978,606, and formulas (particularly a compound 1 (column 3)) in column 2, lines 5 to 10 of U.S. Pat. No. 4,923,787; stain inhibitors: formulas (I) to (III) on page 4, lines 30 to 33, particularly I-47, I-72, III-1, and III-27 (pages 24 to 48) in EP298321A; discoloration inhibitors: A-6, A-7, A-20, A-21, A-23, A-24, A-25, A-26, A-30, A-37, A-40, A-42, A-48, A-63, A-90, A-92, A-94, and A-164 (pages 69 to 118) in EP298321A, II-1 to III-23, particularly III-10 in columns 25 to 38 of U.S. Pat. No. 5,122,444, I-1 to III-4, particularly II-2 on pages 8 to 12 of EP471347A, and A-1 to A-48, particularly A-39 and A-42 in columns 32 to 40 of U.S. Pat. No. 5,139,931; materials which reduce the use amount of a color enhancer or a color amalgamation inhibitor: I-1 to II-15, particularly I-46 on pages 5 to 24 of EP411324A; formalin scavengers: SCV-1 to SCV-28, particularly SCV-8 on pages 24 to 29 of EP477932A; film hardeners: H-1, H-4, H-6, H-8, and H-14 on page 17 of JP-A-1-214845, compounds (H-1 to H-54) represented by formulas (VII) to (XII) in columns 13 to 23 of U.S. Pat. No. 4,618,573, compounds (H-1 to H-76), particularly H-14 represented by formula (6) on page 8, lower right column of JP-A-2-214852, and compounds described in claim 1 of U.S. Pat. No. 3,325,287; development inhibitor precursors: P-24, P-37, and P-39 (pages 6 and 7) in JP-A-62-168139; compounds described in claim 1, particularly 28 and 29 in column 7 of U.S. Pat. No. 5,019,492; antiseptic agents and mildewproofing agents: I-1 to III-43, particularly II-1, II-9, II-10, II-18, and III-25 in columns 3 to 15 of U.S. Pat. No. 4,923,790; stabilizers and antifoggants: I-1 to (14), particularly I-1, I-60, (2), and (13) in columns 6 to 16 of U.S. Pat. No. 4,923,793, and compounds 1 to 65, particularly the compound 36 in columns 25 to 32 of U.S. Pat. No. 4,952,483; chemical sensitizers: triphenylphosphine selenide and a compound 50 in JP-A-5-40324; dyes: a-1 to b-20, particularly a-1, a-12, a-18, a-27, a-35, a-36, and b-5 on pages 15 to 18 and V-1 to V-23, particularly V-1 on pages 27 to 29 of JP-A-3-156450, F-I-1 to F-II-43, particularly F-I-11 and F-II-8 on pages 33 to 55 of EP445627A, III-1 to III-36, particularly III-1 and III-3 on pages 17 to 28 of EP457153A, fine crystal dispersions of Dye-1 to Dye-124 on pages 8 to 26 of WO88/04794, compounds 1 to 22, particularly the compound 1 on pages 6 to 11 of EP319999A, compounds D-1 to D-87 (pages 3 to 28) represented by formulas (1) to (3) in EP519306A, compounds 1 to 22 (columns 3 to 10) represented by formula (I) in U.S. Pat. No. 4,268,622, and compounds (1) to (31) (columns 2 to 9) represented by formula (I) in U.S. Pat. No. 4,923,788; UV absorbents: compounds (18b) to (18r) and 101 to 427 (pages 6 to 9) represented by formula (1) in JP-A-46-3335, compounds (3) to (66) (pages 10 to 44) represented by formula (I) and compounds HBT-1 to HBT-10 (page 14) represented by formula (III) in EP520938A, and compounds (1) to (31) (columns 2 to 9) represented by formula (1) in EP521823A, all the disclosures of which are incorporated herein by reference.

The present invention can be applied to various color sensitive materials such as color negative films for general purposes or movies, color reversal films for slides or television, color paper, color positive films, and color reversal paper. The present invention is also suited to film units with lens described in JP-B-2-32615 and Jpn. UM Appln. KOKOKU Publication No. 3-39784, the disclosures of which are incorporated herein by reference.

A support which can be suitably used in the present invention is described in, e.g., RD. No. 17643, page 28, RD. No. 18716, page 647, right column to page 648, left column, and RD. No. 307105, page 879, the disclosures of which are incorporated herein by reference.

In a sensitive material of the present invention, the total film thickness of all hydrophilic colloid layers on the side having emulsion layers is preferably 28 μm or less, more preferably, 23 μm or less, most preferably, 18 μm or less, and particularly preferably, 16 μm or less. A film swell speed $T_{1/2}$ is preferably 30 sec or less, and more preferably, 20 sec or less. $T_{1/2}$ is defined as a time which the film thickness requires to reach ½ of a saturation film thickness which is 90% of a maximum swell film thickness reached when processing is performed by using a color developer at 30° C. for 3 min and 15 sec. A film thickness means the thickness of a film measured under moisture conditioning at a temperature of 25° C. and a relative humidity of 55% (two days). $T_{1/2}$ can be measured by using a swell meter described in Photogr. Sci. Eng., A. Green et al., Vol. 19, No. 2, pp. 124 to 129, the disclosure of which is incorporated herein by reference. $T_{1/2}$ can be adjusted by adding a film hardening agent to gelatin as a binder or changing aging conditions after coating. The swell ratio is preferably 150 to 400%. The swell ratio can be calculated from the maximum swell film thickness under the conditions mentioned above by using formula:

(maximum swell film thickness−film thickness)/film thickness.

In a sensitive material of the present invention, hydrophilic colloid layers (called back layers) having a total dried film thickness of 2 to 20 μm are preferably formed on the side opposite to the side having emulsion layers. The back layers preferably contain, e.g., the aforementioned light absorbents, filter dyes, ultraviolet absorbents, antistatic agents, film hardeners, binders, plasticizers, lubricants, coating aids, and surfactants. The swell ratio of the back layers is preferably 150 to 500%.

A sensitive material according to the present invention can be developed by conventional methods described in RD. No. 17643, pp. 28 and 29, RD. No. 18716, page 651, left to right columns, and RD No. 307105, pp. 880 and 881, the disclosures of which are incorporated herein by reference.

Color negative film processing solutions used in the present invention will be described below. Compounds described in JP-A-4-121739, page 9, upper right column, line 1 to page 11, lower left column, line 4 can be used in a color developer of the present invention, the disclosure of which is incorporated herein by reference. As a color developing agent used when particularly rapid processing is to be performed, 2-methyl-4-[N-ethyl-N-(2-hydroxyethyl)amino] aniline, 2-methyl-4-[N-ethyl-N-(3-hydroxypropyl)amino] aniline, or 2-methyl-4-[N-ethyl-N-(4-hydroxybutyl)amino] aniline is preferred.

The use amount of any of these color developing agents is preferably 0.01 to 0.08 mol, more preferably, 0.015 to 0.06 mol, and most preferably, 0.02 to 0.05 mol per liter (to be also referred to as "L" hereinafter) of a color developer. Also, a replenisher of a color developer preferably contains a color developing agent at a concentration 1.1 to 3 times, particularly 1.3 to 2.5 times the above concentration.

As a preservative of a color developer, hydroxylamine can be extensively used. If higher preservability is necessary, the use of a hydroxylamine derivative having a substituent such as an alkyl group, hydroxyalkyl group, sulfoalkyl group, or carboxyalkyl group is preferable. Preferred examples are N,N-di(sulfoethyl)hydroxylamine, monomethylhydroxylamine, dimethylhydroxylamine, monoethylhydroxylamine, diethylhydroxylamine, and N,N-di(carboxylethyl) dxhydroylamine. Of these d erivatives, N,N-di(sulfoethyl)hydroxylamine is particularly preferred. Although these derivatives can be used together with hydroxylamine, it is preferable to use one or two types of these derivatives instead of hydroxylamine.

The use amount of a preservative is preferably 0.02 to 0.2 mol, more preferably, 0.03 to 0.15 mol, and most preferably, 0.04 to 0.1 mol per L of a color developer. As in the case of a color developing agent, a replenisher preferably contains a preservative at a concentration 1.1 to 3 times that of a mother solution (processing tank solution).

A color developer contains sulfite as an agent for preventing an oxide of a color developing agent from changing into tar. The use amount of this sulfite is preferably 0.01 to 0.05 mol, and more preferably, 0.02 to 0.04 mol per L. Sulfite is preferably used at a concentration 1.1 to 3 times the above concentration in a replenisher.

The pH of a color developer is preferably 9.8 to 11.0, and more preferably, 10.0 to 10.5. In a replenisher, the pH is preferably set to be higher by 0.1 to 1.0 than these values. To stably maintain this pH, a known buffering agent such as carbonate, phosphate, sulfosalicylate, or borate is used. The replenishment rate of a color developer is preferably 80 to 1,300 mL per $m^2$ of a sensitive material. However, the replenishment rate is preferably smaller in order to reduce environmental pollution. For example, the replenishment rate is preferably 80 to 600 mL, and more preferably, 80 to 400 mL.

The bromide ion concentration in the color developer is usually 0.01 to 0.06 mol per L. However, this bromide ion concentration is preferably set at 0.015 to 0.03 mol per L in order to suppress fog and improve discrimination and graininess while maintaining sensitivity. To set the bromide ion concentration in this range, it is only necessary to add bromide ions calculated by the following equation to a replenisher. If C takes a negative value, however, no bromide ions are preferably added to a replenisher.

$$C=A-W/V$$

where C: the bromide ion concentration (mol/L) in a color developer replenisher

A: the target bromide ion concentration (mol/L) in a color developer

W: the amount (mol) of bromide ions dissolving into the color developer from 1 $m^2$ of a sensitive material when the sensitive material is color-developed V: the replenishment rate (L) of the color developer replenisher per 1 $m^2$ of the sensitive material As a method of increasing the sensitivity when the replenishment rate is decreased or high bromide ion concentration is set, it is preferable to use a development accelerator such as pyrazolidones represented by 1-phenyl-3-pyrazolidone and 1-phenyl-2-methyl-2-hydroxylmethyl-3-pyrazolidone, or a thioether compound represented by 3,6-dithia-1,8-octandiol.

Compounds and processing conditions described in JP-A-4-125558, page 4, lower left column, line 16 to page 7, lower left column, line 6 can be applied to a processing solution having bleaching capacity in the present invention, the disclosure of which is incorporated herein by reference. This bleaching agent preferably has an oxidation-reduction potential of 150 mV. Favored practical examples of the bleaching agent are described in JP-A's-5-72694 and 5-173312, the disclosures of which are incorporated herein by reference. In particular, 1,3-diaminopropane tetraacetic acid and ferric complex salt of a compound as practical example 1 in JP-A-5-173312, page 7 are preferred, the disclosure of which is incorporated herein by reference.

To improve the biodegradability of a bleaching agent, it is preferable to use compound ferric complex salts described in JP-A-4-251845, JP-A-4-268552, EP588,289, EP591,934, and JP-A-6-208213 as the bleaching agent, the disclosures of which are incorporated herein by reference. The concentration of any of these bleaching agents is preferably 0.05 to 0.3 mol per L of a solution having bleaching capacity. To reduce the amount of waste to the environment, the concentration is preferably designed to be 0.1 to 0.15 mol per L of the solution having bleaching capacity. When the solution having bleaching capacity is a bleaching solution, preferably 0.2 to 1 mol, and more preferably, 0.3 to 0.8 mol of a bromide is added per L.

A replenisher of the solution having bleaching capacity basically contains components at concentrations calculated by the following equation. This makes it possible to maintain the concentrations in a mother solution constant.

$$CR=CT\times(V1+V2)/V1+CP$$

where CR: the concentrations of components in a replenisher

CT: the concentrations of components in a mother solution (processing tank solution)

CP: the concentrations of components consumed during processing

V1: the replenishment rate (mL) of a replenisher having bleaching capacity per $m^2$ of a sensitive material V2: an amount (mL) carried over from a pre-bath by $m^2$ of the sensitive material Additionally, a bleaching solution preferably contains a pH buffering agent, and more preferably contains succinic acid, maleic acid, malonic acid, glutaric acid, adipic acid, or dicarboxylic acid with little odor. Also, the use of known bleaching accelerators described in JP-A-53-95630, RD No. 17129, and U.S. Pat. No. 3,893,858 is preferable, the disclosures of which are incorporated herein by reference.

It is preferable to replenish 50 to 1,000 mL of a bleaching replenisher to a bleaching solution per $m^2$ of a sensitive material. The replenishment rate is more preferably 80 to 500 mL, and most preferably, 100 to 300 mL. Aeration of a bleaching solution is also preferable.

Compounds and processing conditions described in JP-A-4-125558, page 7, lower left column, line 10 to page 8, lower right column, line 19 can be applied to a processing solution with fixing capacity, the disclosure of which is incorporated herein by reference.

In particular, to improve the fixing rate and preservability, compounds represented by formulas (I) and (II) described in JP-A-6-301169 are preferably added singly or together to a processing solution with fixing capacity, the disclosure of which is incorporated herein by reference. To improve the preservability, the use of sulfinic acid such as p-toluenesulfinate described in JP-A-1-224762 is also preferable, the disclosure of which is incorporated herein by reference.

To improve the desilvering characteristics, ammonium is preferably used as a cation in a solution with bleaching capacity or in a solution with fixing capacity. However, the amount of ammonium is preferably reduced, or zero, to reduce environmental pollution.

In the bleaching, bleach-fixing, and fixing steps, it is particularly preferable to perform jet stirring described in JP-A-1-309059, the disclosure of which is incorporated herein by reference.

The replenishment rate of a replenisher in the bleach-fixing or fixing step is preferably 100 to 1,000 mL, more preferably, 150 to 700 mL, and most preferably, 200 to 600 mL per $m^2$ of a sensitive material. In the bleach-fixing or fixing step, an appropriate silver collecting apparatus is preferably installed either in-line or off-line to collect silver. When the apparatus is installed in-line, processing can be performed while the silver concentration in a solution is reduced, so the replenishment rate can be reduced. It is also preferable to install the apparatus off-line to collect silver and reuse the residual solution as a replenisher.

The bleach-fixing or fixing step can be performed by using a plurality of processing tanks, and these tanks are preferably cascaded to form a multistage counterflow system. To balance the system with the size of a processor, a two-tank cascade system is generally efficient. The processing time ratio of the front tank to the rear tank is preferably 0.5:1 to 1:0.5, and more preferably, 0.8:1 to 1:0.8.

In a bleach-fixing or fixing solution, the presence of free chelating agents which are not metal complexes is preferable to improve the preservability. As these chelating agents, the use of the biodegradable chelating agents previously described in connection to a bleaching solution is preferred.

Contents described in aforementioned JP-A-4-125558, page 12, lower right column, line 6 to page 13, lower right column, line 16 can be preferably applied to the washing and stabilization steps, the disclosure of which is incorporated herein by reference. To improve the safety of the work environment, it is preferable to use azolylmethylamines described in EP504,609 and EP519,190 or N-methylolazoles described in JP-A-4-362943 instead of formaldehyde in a stabilizer and to make a magenta coupler divalent to form a solution of surfactant containing no image stabilizing agent such as formaldehyde, all the disclosures of which are incorporated herein by reference. To reduce adhesion of dust to a magnetic recording layer formed on a sensitive material, a stabilizer described in JP-A-6-289559 can be preferably used, the disclosure of which is incorporated herein by reference.

The replenishment rate of washing water and a stabilizer is preferably 80 to 1,000 mL, more preferably, 100 to 500 mL, and most preferably, 150 to 300 mL per $m^2$ of a sensitive material in order to maintain the washing and stabilization functions and at the same time reduce the waste liquors for environmental protection. In processing performed with this replenishment rate, it is preferable to prevent the propagation of bacteria and mildew by using known mildewproofing agents such as thiabendazole, 1,2-benzoisothiazoline-3-one, and 5-chloro-2-methylisothiazoline-3-one, antibiotics such as gentamicin, and water deionized by an ion exchange resin or the like. It is more effective to use deionized water together with a mildewproofing agent or an antibiotic.

The replenishment rate of a solution in a washing water tank or stabilizer tank is preferably reduced by performing reverse permeable membrane processing described in JP-A-3-46652, JP-A-3-53246, JP-A-3-55542, JP-A-3-121448, and JP-A-3-126030, the disclosures of which are incorporated herein by reference. A reverse permeable membrane used in this processing is preferably a low-pressure reverse permeable membrane.

In the processing of the present invention, it is particularly preferable to perform evaporation correction of processing solution disclosed in JIII Journal of Technical Disclosure No. 94-4992, the disclosure of which is incorporated herein by reference. In particular, a method of performing correction on the basis of (formula-1) on page 2 by using temperature and humidity information of an environment in which a processor is installed is preferred. Water for use in this evaporation correction is preferably taken from the washing water replenishment tank. If this is the case, deionized water is preferably used as the washing replenishing water.

Processing agents described in aforementioned JIII Journal of Technical Disclosure No. 94-4992, page 3, right column, line 15 to page 4, left column, line 32 are preferably used in the present invention, the disclosure of which is incorporated herein by reference. As a processor for these processing agents, a film processor described on page 3, right column, lines 22 to 28 is preferred.

Practical examples of processing agents, automatic processors, and evaporation correction methods suited to practicing the present invention are described in the same JIII Journal of Technical Disclosure No. 94-4992, page 5, right column, line 11 to page 7, right column, last line, the disclosure of which is incorporated herein by reference.

Processing agents used in the present invention can be supplied in any form: a liquid agent having the concentration of a solution to be used, concentrated liquid agent, granules, powder, tablets, paste, and emulsion, and the like. Examples of such processing agents are a liquid agent contained in a low-oxygen-permeable vessel disclosed in JP-A-63-17453, vacuum-packed powders and granules disclosed in JP-A-4-19655 and JP-A-4-230748, granules containing a water-soluble polymer disclosed in JP-A-4-221951, tablets disclosed in JP-A-51-61837 and JP-A-6-102628, and a paste disclosed in PCT National Publication No. 57-500485, all the disclosures of which are incorporated herein by reference. Although any of these processing agents can be preferably used, the use of a liquid adjusted to have the concentration of a solution to be used is preferable for the sake of convenience in use.

As a vessel for containing these processing agents, polyethylene, polypropylene, polyvinylchloride, polyethyleneterephthalate, and nylon are used singly or as a composite material. These materials are selected in accordance with the level of necessary oxygen permeability. For a readily oxidizable solution such as a color developer, a low-oxygen-permeable material is preferred. More specifically, polyethyleneterephthalate or a composite material of polyethylene and nylon is favorable. A vessel made of any of these materials preferably has a thickness of 500 to 1,500 μm and an oxygen permeability of 20 $mL/m^2 \cdot 24$ hrs·atm or less.

Color reversal film processing solutions used in the present invention will be described below.

Processing for a color reversal film is described in detail in Aztech Ltd., Known Technology No. 6 (Apr. 1, 1991), page 1, line 5 to page 10, line 5 and page 15, line 8 to page 24, line 2, and any of the contents can be preferably applied, the disclosure of which is incorporated herein by reference.

In this color reversal film processing, an image stabilizing agent is contained in a control bath or a final bath. Preferable examples of this image stabilizing agent are formalin, sodium formaldehyde-bisulfite, and N-methylolazole. Sodium formaldehyde-bisulfite or N-methylolazole is preferred in terms of work environment, and N-methyloltriazole is particularly preferred as N-methylolazole. The contents pertaining to a color developer, bleaching solution, fixing solution, and washing water described in the color negative film processing can be preferably applied to the color reversal film processing.

Preferred examples of color reversal film processing agents containing the above contents are the E-6 processing agent manufactured by Eastman Kodak Co. and the CR-56 processing agent manufactured by Fuji Photo Film Co., Ltd.

A color photographic lightsensitive material of the present invention is also suitably used as a negative film for an advanced photo system (to be referred to as an APS hereinafter). Examples are NEXIA A, NEXIA F, and NEXIA H (ISO 200, 100, and 400, respectively) manufactured by Fuji Photo Film Co., Ltd. (to be referred to as Fuji Film hereinafter). These films are so processed as to have an APS format and set in an exclusive cartridge. These APS cartridge films are loaded into APS cameras such as the Fuji Film EPION Series (e.g., the EPION 300Z). A color photographic lightsensitive material of the present invention is also suited as a film with lens such as the Fuji Film FUJICOLOR UTSURUNDESU SUPER SLIM.

A photographed film is printed through the following steps in a mini-lab system.

(1) Reception (an exposed cartridge film is received from a customer)

(2) Detaching step (the film is transferred from the cartridge to an intermediate cartridge for development)

(3) Film development (4) Reattaching step (the developed negative film is returned to the original cartridge)

(5) Printing (prints of three types C, H, and P and an index print are continuously automatically printed on color paper [preferably the Fuji Film SUPER FA8])

(6) Collation and shipment (the cartridge and the index print are collated by an ID number and shipped together with the prints)

As these systems, the Fuji Film MINI-LAB CHAMPION SUPER FA-298, FA-278, FA-258, FA-238 and the Fuji Film FRONTIER digital lab system are preferable. Examples of a film processor for the MINI-LAB CHAMPION are the FP922AL, FP562B, FP562B,AL, FP362B, and FP3622B, AL, and a recommended processing chemical is the FUJICOLOR JUST-IT CN-16L and CN-16Q. Examples of a printer processor are the PP3008AR, PP3008A, PP1828AR, PP1828A, PP1258AR, PP1258A, PP728AR, and PP728A, and a recommended processing chemical is the FUJICOLOR JUST-IT CP-47L and CP-40FAII. In the FRONTIER system, the SP-1000 scanner & image processor and the LP-1000P laser printer & paper processor or the LP-1000W laser printer are used. A detacher used in the detaching step and a reattacher used in the reattaching step are preferably the Fuji Film DT200 or DT100 and AT200 or AT100, respectively.

The APS can also be enjoyed by PHOTO JOY SYSTEM whose main component is the Fuji Film Aladdin 1000 digital image workstation. For example, a developed APS cartridge film is directly loaded into the Aladdin 1000, or image information of a negative film, positive film, or print is input to the Aladdin 1000 by using the FE-550 35-mm film scanner or the PE-550 flat head scanner. Obtained digital image data can be easily processed and edited. This data can be printed out by the NC-550AL digital color printer using a photo-fixing heat-sensitive color printing system or the PICTOROGRAPHY 3000 using a laser exposure thermal development transfer system, or by existing laboratory equipment through a film recorder. The Aladdin 1000 can also output digital information directly to a floppy disk or Zip disk or to an CD-R via a CD writer.

In a home, a user can enjoy photographs on a TV set simply by loading a developed APS cartridge film into the Fuji Film PHOTO PLAYER AP-1. Image information can also be continuously input to a personal computer by loading a developed APS cartridge film into the Fuji Film PHOTO SCANNER AS-1. The Fuji Film PHOTO VISION FV-10 or FV-5 can be used to input a film, print, or three-dimensional object. Furthermore, image information recorded in a floppy disk, Zip disk, CD-R, or hard disk can be variously processed on a computer by using the Fuji Film PHOTO FACTORY application software. The Fuji Film NC-2 or NC-2D digital color printer using a photo-fixing heat-sensitive color printing system is suited to outputting high-quality prints from a personal computer.

To keep developed APS cartridge films, the FUJICOLOR POCKET ALBUM AP-5 POP L, AP-1 POP L, or AP-1 POP KG, or the CARTRIDGE FILE 16 is preferred.

The present invention will be described in more detail below by way of its examples. However, the present invention is not limited to these examples.

EXAMPLE-1

A method of preparing perfect epitaxial tabular grains according to the present invention will be described below.

(Preparation of Seed Emulsion a)

1,164 mL of an aqueous solution containing 0.017 g of KBr and 0.4 g of gelatin with an average molecular weight of 100,000 were held at 45° C. and stirred. An aqueous solution of $AgNO_3$ (1.6 g) and an aqueous KBr solution were added by the double-jet method over 30 sec. The concentration of the $AgNO_3$ solution was 0.8 mol/liter. During the addition, the silver potential was held at 15 mV with respect to a saturated calomel electrode. An aqueous KBr solution was added to set the silver potential to −60 mV, and the temperature was raised to 75° C. After 21 g of oxidization-processed gelatin with an average molecular weight of 100,000 were added, an aqueous solution of $AgNO_3$ (206.3 g) and an aqueous KBr solution were added by the double-jet method over 61 min while the flow rates were accelerated. During the addition, the silver potential was held at −50 mV with respect to the saturated calomel electrode. After the resultant material was desalted, oxidization-processed gelatin with an average molecular weight of 100,000 was added, and the pH and the pAg were adjusted to 5.8 and 8.8, respectively, at 40° C., thereby preparing a seed emulsion. This seed emulsion contained 1 mol of Ag and 80 g of gelatin per kg of the emulsion. The emulsion consisted of tabular grains with an average equivalent-circle diameter of 1.60 μm, an equivalent-circle diameter variation coefficient of 38%, an average thickness of 0.043 μm, and an average aspect ratio of 37.

(Preparation of Host Tabular Grain Emulsion b)

1,200 mL of an aqueous solution containing 134 g of the above seed emulsion a, 1.9 g of KBr, and 22 g of oxidization-processed gelatin with an average molecular weight of 100,000 were held at 75° C. and stirred. An aqueous solution of $AgNO_3$ (137.5 g) and an aqueous KBr solution were added over 25 min. During the addition, the silver potential was held at −50 mV with respect to a saturated calomel electrode. After that, an aqueous solution of $AgNO_3$ (30.0 g) and an aqueous KBr solution containing KI were added by the double-jet method over 30 min while the flow rates were accelerated. The KI concentration was so adjusted that the silver iodide content was 15 mol %. In the middle of the addition, iridium potassium hexachloride and sodium benzenethiosulfonate were added. During the addition, the silver potential was held at −40 mV with respect to the saturated calomel electrode. After that, an aqueous solution of $AgNO_3$ (36.4 g) and an aqueous KBr solution containing KI were added over 25 min while the flow rates were accelerated. The KI concentration was so adjusted that the silver iodide content was 15 mol %. During the addition, the silver potential was held at −30 mV with respect to the saturated calomel electrode. The resultant material was normally washed with water, gelatin with a molecular weight of 100,000 was added, and the pH and the pBr were adjusted to 5.8 and 4.0, respectively, at 40° C., thereby preparing a emulsion b. This emulsion b consisted of tabular grains with an average equivalent-circle diameter of 4.2 μm, an equivalent-circle diameter variation coefficient of 38%, an average thickness of 0.063 μm, and an average aspect ratio of 67. 90% or more of the total projected area were accounted for by grains having an equivalent-circle diameter of 3.0 a m or more and a thickness of 0.07 μm or less. Also, 45% of the total projected area were accounted for by non-hexagonal tabular grains having a ratio of the length of an edge having the maximum length to the length of an edge having the minimum length of 2 or more. When the grains were observed at a low temperature by a transmission electron microscope, one or more dislocation lines were found in portions except for apex portions in grains at a ratio of 35% of the total projected area. The ratio of (111) faces in side faces was 90%.

(Preparation of Seed Emulsion c)

1,164 mL of an aqueous solution containing 0.017 g of KBr and 0.4 g of oxidization-processed gelatin with an average molecular weight of 20,000 were held at 30° C. and stirred. An aqueous solution of $AgNO_3$ (1.6 g), an aqueous KBr solution, and an aqueous solution of oxidization-processed gelatin (2.1 g) with an average molecular weight of 20,000 were added by the triple-jet method over 30 sec. The concentration of the $AgNO_3$ solution was 0.2 mol/liter. During the addition, the silver potential was held at 15 mv with respect to a saturated calomel electrode. An aqueous KBr solution was added to set the silver potential to −60 mV, and the temperature was raised to 75° C. 21 g of succinated gelatin with an average molecular weight of 100,000 were added. An aqueous solution of $AgNO_3$ (206.3 g) and an aqueous KBr solution were added by the double-jet method over 61 min while the flow rates were accelerated. During the addition, the silver potential was held at −40 mV with respect to the saturated calomel electrode. After the resultant material was desalted, succinated gelatin with an average molecular weight of 100,000 was added, and the pH and the pAg were adjusted to 5.8 and 8.8, respectively, at 40° C., thereby preparing a seed emulsion. This seed emulsion contained 1 mol of Ag and 80 g of gelatin per kg of the emulsion. The emulsion consisted of tabular grains with an average equivalent-circle diameter of 1.60 g m, an equivalent-circle diameter variation coefficient of 22%, an average thickness of 0.043 μm, and an average aspect ratio of 37.

(Preparation of Host Tabular Grain Emulsion d)

1,200 mL of an aqueous solution containing 134 g of the above seed emulsion c, 1.9 g of KBr, and 22 g of succinated gelatin with an average molecular weight of 100,000 were held at 75° C. and stirred. An aqueous solution of $AgNO_3$ (137.5 g), an aqueous KBr solution, and an aqueous solution of oxidization-processed gelatin with a molecular weight of 20,000 were mixed in another chamber having a magnetic coupling induction type stirrer described in JP-A-10-43570, and the mixture was immediately added over 25 min. During the addition, the silver potential was held at −40 mV with respect to a saturated calomel electrode. After that, an aqueous solution of $AgNO_3$ (30.0 g), an aqueous KBr solution, and a previously prepared AgI ultrafine-grain emulsion were added by the triple-jet method over 30 min at fixed flow rates. The addition amount of the AgI ultrafine-grain emulsion was so adjusted that the silver iodide content was 15 mol %. Also, this AgI ultrafine-grain emulsion had an equivalent-circle diameter of 0.03 μm and an equivalent-circle diameter variation coefficient of 17% and contained trimellitated gelatin as disperse gelatin. In the middle of the addition, iridium potassium hexachloride and sodium benzenethiosulfonate were added. During the addition, the silver potential was held at −20 mv with respect to the saturated calomel electrode. After that, an aqueous solution of $AgNO_3$ (36.4 g) and an aqueous KBr solution containing KI were added over 30 min at fixed flow rates. The KI concentration was so adjusted that the silver iodide content was 15 mol %. During the addition, the silver potential was held at +15 mV with respect to the saturated calomel electrode. The resultant material was normally washed with water, gelatin with a molecular weight of 100,000 was added, and the pH and the pBr were adjusted to 5.8 and 4.0, respectively, at 40° C., thereby preparing an emulsion d. This emulsion d consisted of tabular grains with an average equivalent-circle diameter of 4.2 μm, an equivalent-circle diameter variation coefficient of 19%, an average thickness of 0.062 μm, and an average aspect ratio of 68. 90% or more of the total projected area were accounted for by grains having an equivalent-circle diameter of 3.0 μm or more and a thickness of 0.07 μm or less. Also, 90% or more of the total projected area were accounted for by hexagonal tabular grains having a ratio of the length of an edge having the maximum length to the length of an edge having the minimum length of 1.4 or less. When the grains were observed at a low temperature by a transmission electron microscope, one or more dislocation lines were found in portions except for apex portions in grains at a ratio of 30% of the total projected area. The ratio of (111) faces in side faces was 85%.

(Preparation of Host Tabular Grain Emulsion e)

1,200 mL of an aqueous solution containing 134 g of the above seed emulsion c, 1.9 g of KBr, and 22 g of succinated gelatin with an average molecular weight of 100,000 were held at 75° C. and stirred. An aqueous solution of $AgNO_3$ (137.5 g), an aqueous KBr solution, and an aqueous solution of oxidization-processed gelatin with a molecular weight of 20,000 were mixed in another chamber having the magnetic coupling induction type stirrer described in JP-A-10-43570, and the mixture was immediately added over 25 min. During the addition, the silver potential was held at −40 mV with respect to a saturated calomel electrode. After that, an aqueous solution of $AgNO_3$ (30.0 g), an aqueous KBr solution, and a previously prepared AgI ultrafine-grain emulsion were added by the triple-jet method over 30 min at fixed flow rates. The addition amount of the AgI ultrafine-grain emulsion was so adjusted that the silver iodide content was 15 mol %. Also, this AgI ultrafine-grain emulsion had an equivalent-circle diameter of 0.03 μm and an equivalent-circle diameter variation coefficient of 17% and contained trimellitated gelatin as disperse gelatin. In the middle of the addition, iridium potassium hexachloride and sodium benzenethiosulfonate were added. During the addition, the silver potential was held at −20 mV with respect to the saturated calomel electrode. After that, an aqueous solution of $AgNO_3$ (36.4 g), an aqueous KBr solution, and the previously prepared AgI ultrafine-grain emulsion described above were added over 40 min at fixed flow rates. The addition amount of the AgI ultrafine-grain emulsion was so adjusted that the silver iodide content was 15 mol %. During the addition, the silver potential was held at +80 mV with respect to the saturated calomel electrode. The resultant material was normally washed with water, high-molecular-weight gelatin with a molecular weight of 150,000 was added, and the pH and the pBr were adjusted to 5.8 and 4.0, respectively, at 40° C., thereby preparing an emulsion e. This emulsion e consisted of tabular grains with an average equivalent-circle diameter of 4.2 μm, an equivalent-circle diameter variation coefficient of 19%, an average thickness of 0.062 μm, and an average aspect ratio of 68. 90% or more of the total projected area were accounted for by grains having an equivalent-circle diameter of 3.0 μm or more and a thickness of 0.07 μm or less. Also, 90% or more of the total projected area were accounted for by hexagonal tabular grains having a ratio of the length of an edge having the maximum length to the length of an edge having the minimum length of 1.4 or less. When the grains were observed at a low temperature by a transmission electron microscope, no dislocation lines were found in portions except for apex portions in grains at a ratio of 90% or more of the total projected area. The ratio of (111) faces in side faces was 68%.

(Epitaxial Deposition and Chemical Sensitization)

Each of epitaxial deposition processes ① to ③ described below were performed for each of the host tabular grains emulsions b, d, and e.

① The host tabular grain emulsion was dissolved at 40° C., and $3\times10^{-3}$ mol of an aqueous KI solution was added to 1 mol of the silver amount of the host tabular grains. Sensitizing dyes I, II, and III at a molar ratio of 6:3:1 were added at a ratio of 70% of the saturated covering amount. These sensitizing dyes were used as fine solid dispersions formed by a method described in JP-A-11-52507. That is, 0.8 parts by weight of sodium nitrate and 3.2 parts by weight of sodium sulfate were dissolved in 43 parts by weight of ion-exchanged water. To this solution, 13 parts by weight of the sensitizing dye were added, and the resultant solution was dispersed for 20 min at 60° C. and 2,000 rpm by using a dissolver blade, thereby obtaining a solid dispersion of the sensitizing dye. $3.1\times10^{-6}$ mol (with respect to 1 mol of the silver amount of the host tabular grains; the same shall apply hereinafter) of potassium hexacyanoruthenium(II) acid was added, and $1.5\times10^{-2}$ mol of an aqueous KBr solution was added. After that, $3.0\times10^{-2}$ mol of an aqueous 1 mol/liter silver nitrate solution and $2.7\times10^{-2}$ mol of an aqueous NaCl solution were added at fixed flow rates over 10 min by the double-jet method. At the end of the addition, the silver potential was +85 mV with respect to a saturated calomel electrode. After $5\times10^{-5}$ mol of an antifoggant I was added, the emulsion was heated to 50° C. and optimally chemically sensitized by adding potassium thiocyanate, chloroauric acid, sodium thiosulfate, and N,N-dimethylselenourea. $5\times10^{-4}$ mol of the antifoggant I was added to complete the chemical sensitization.

Sensitizing dyes I, II, & III, antifoggant I

Sensitizing dye I

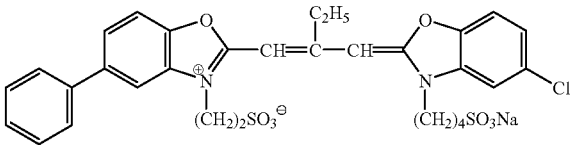

Sensitizing dye II

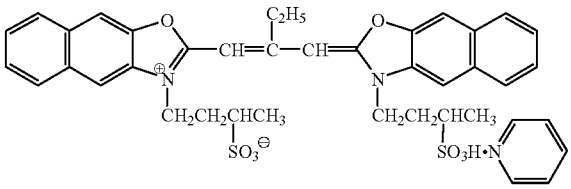

Sensitizing dye III

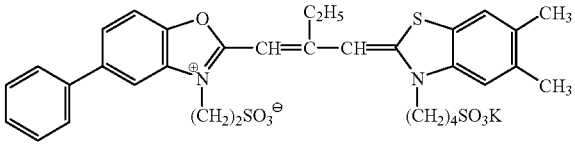

-continued

Antifoggant I

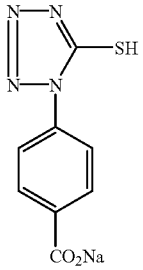

② The host tabular grain emulsion was dissolved at 40° C., and $3\times10^{-3}$ mol of the aforementioned AgI fine-grain emulsion was added to 1 mol of the silver amount of the host tabular grains. The sensitizing dyes I, II, and III at a molar ratio of 6:3:1 were added at a ratio of 70% of the saturated covering amount. These sensitizing dyes were used as fine solid dispersions formed by the method described in JP-A-11-52507. That is, 0.8 parts by weight of sodium nitrate and 3.2 parts by weight of sodium sulfate were dissolved in 43 parts by weight of ion-exchanged water. To this solution, 13 parts by weight of the sensitizing dye were added, and the resultant solution was dispersed for 20 min at 60° C. and 2,000 rpm by using a dissolver blade, thereby obtaining a solid dispersion of the sensitizing dye. $3.1\times10^{-6}$ mol (with respect to 1 mol of the silver amount of the host tabular grains; the same shall apply hereinafter) of potassium hexacyanoruthenium(II) acid was added, and $1.5\times10^{-2}$ mol of an aqueous KBr solution was added. After $2.7\times10^{-2}$ mol of an aqueous NaCl solution was added, $3.0\times10^{-2}$ mol of an aqueous 0.1 mol/liter silver nitrate solution was added at a fixed flow rate over 1 min. At the end of the addition, the silver potential was +85 mv with respect to a saturated calomel electrode. After $5\times10^{-5}$ mol of the antifoggant I was added, the emulsion was heated to 50° C. and optimally chemically sensitized by adding potassium thiocyanate, chloroauric acid, sodium thiosulfate, and N,N-dimethylselenourea. $5\times10^{-4}$ mol of the antifoggant I was added to complete the chemical sensitization.

③ The host tabular grain emulsion was dissolved at 40° C., and $3\times10^{-3}$ mol of the aforementioned AgI fine-grain emulsion was added to 1 mol of the silver amount of the host tabular grains. The sensitizing dyes I, II, and III at a molar ratio of 6:3:1 were added at a ratio of 70% of the saturated covering amount. These sensitizing dyes were used as fine solid dispersions formed by the method described in JP-A-11-52507. That is, 0.8 parts by weight of sodium nitrate and 3.2 parts by weight of sodium sulfate were dissolved in 43 parts by weight of ion-exchanged water. To this solution, 13 parts by weight of the sensitizing dye were added, and the resultant solution was dispersed for 20 min at 60° C. and 2,000 rpm by using a dissolver blade, thereby obtaining a solid dispersion of the sensitizing dye. $3.1\times10^{-6}$ mol (with respect to 1 mol of the silver amount of the host tabular grains; the same shall apply hereinafter) of potassium hexacyanoruthenium(II) acid was added, and $1.5\times10^{-2}$ mol of an aqueous KBr solution was added. After that, $3.0\times10^{-2}$ mol of an aqueous 0.1 mol/liter silver nitrate solution and $2.7\times10^{-2}$ mol of an aqueous NaCl solution were added at fixed flow rates over 2 min by the double-jet method. At the end of the addition, the silver potential was +85 mV with respect to a saturated calomel electrode. After $5\times10^{-5}$ mol of the antifoggant I was added, an aqueous KBr solution was added to adjust the silver potential to +20 mV with respect to the saturated calomel electrode. The emulsion was heated to 50° C. and optimally chemically sensitized by adding potassium thiocyanate, chloroauric acid, sodium thiosulfate, and N,N-dimethylselenourea. $5\times10^{-4}$ mol of the antifoggant I was added to complete the chemical sensitization.

The distributions of the silver iodide content and silver chloride content between grains of each of the emulsions prepared by combining the above epitaxial deposition processes with the host tabular grain emulsions were measured using the EPMA method. Also, the state of epitaxial deposition was observed with an electron microscope by using a replica. The results are collectively shown in Table 1. The average silver iodide content and average silver chloride content of the emulsions described in Table 1 were 4.5 mol % and 1.2 mol %, respectively.

TABLE 1

| Host tabular grain emulsion | Epitaxial deposition method | Variation coefficient of equivalent-circle diameter (%) | Ratio of hexagonal tabular grains (%) | Ratio of grains having dislocation lines (%) | Ratio of (111) faces in side faces (%) | Ratio of 0.8 to 1.2 CL (%) | Ratio of 0.8 to 1.2 I (%) | Ratio of perfect epitaxial emulsion (%) | Remarks |
|---|---|---|---|---|---|---|---|---|---|
| b | ① | 38 | 55 | 35 | 90 | 50 | 55 | 40 | Comparative example |
| b | ② | 38 | 55 | 35 | 90 | 65 | 60 | 50 | Comparative example |
| b | ③ | 38 | 55 | 35 | 90 | 70 | 60 | 55 | Comparative example |
| d | ① | 19 | 95 | 30 | 85 | 65 | 70 | 70 | Present invention |
| d | ② | 19 | 95 | 30 | 85 | 80 | 80 | 75 | Present invention |
| d | ③ | 19 | 95 | 30 | 85 | 90 | 80 | 85 | Present invention |
| e | ① | 19 | 95 | 5 | 68 | 80 | 90 | 85 | Present invention |
| e | ② | 19 | 95 | 5 | 68 | 90 | 95 | 90 | Present invention |
| e | ③ | 19 | 95 | 5 | 68 | 95 | 95 | 95 | Present invention |

Table 1 shows that the ratio of perfect epitaxial tabular grains changes in accordance with the host tabular grain emulsion preparation method and the epitaxial deposition method. Table 1 also shows that these changes in the ratio are largely influenced by the variation coefficient of equivalent-circle diameter, the ratio of the hexagonal tabular grains, the ratio of grains having dislocation lines, the ratio of (111) faces in side faces, the distribution of inter-grain silver chloride content, and the distribution of inter-grain silver iodide content. In Table 1, the ratio of the hexagonal tabular grains means the ratio of the hexagonal tabular grains which have a ratio of the length of an edge having the maximum length to the length of an edge having the minimum length of 2 or less.

A cellulose triacetate film support having an undercoat layer was coated with the emulsions subjected to the above chemical sensitization under the coating conditions shown in Table 2 below and a protective layer was also formed. In this manner, sample Nos. 1 to 9 described in Table 3 were formed.

TABLE 2

| Emulsion Coating Conditions | | |
|---|---|---|
| (1) | Emulsion layer | |
| | Emulsions | Various emulsions (Silver $2.1\times10^{-2}$ mol/m$^2$) |
| | Coupler | ($1.5\times10^{-3}$ mol/m$^2$) |

TABLE 2-continued

Emulsion Coating Conditions

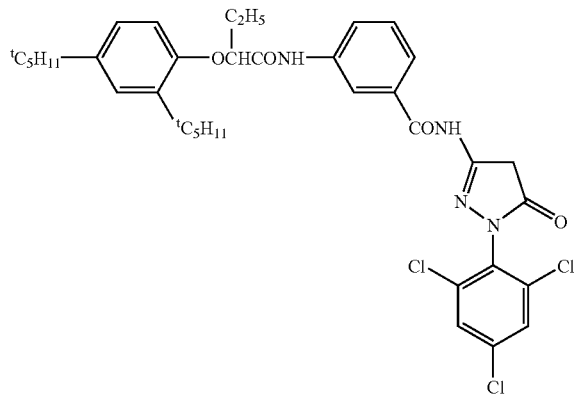

($1.1\times10^{-4}$ mol/m$^2$)

TABLE 2-continued

| Emulsion Coating Conditions | | |
|---|---|---|
| | 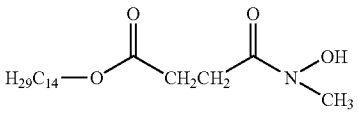 | |
| | Tricresylphosphate | (1.10 g/m$^2$) |
| | Gelatin | (2.30 g/m$^2$) |
| (2) | Protective layer | |
| | 2,4-dichloro-6-hydroxy-s-triazine sodium salt | (0.08 g/m$^2$) |
| | Gelatin | (1.80 g/m$^2$) |

These samples were left to stand at 40° C. and a relative humidity of 70% for 14 hours. The resultant samples were exposed for 1/100 sec through the SC-50 gelatin filter manufactured by Fuji Photo Film Co., Ltd. and a continuous wedge.

By using the FP-350 negative processor manufactured by Fuji Photo Film Co., Ltd., the exposed samples were processed by the following method (until the accumulated replenisher amount of each solution was three times the mother solution tank volume).

(Processing Method)

| Step | Time | Temperature | Replenishment rate* |
|---|---|---|---|
| Color development | 3 min. 15 sec. | 38° C. | 45 mL |
| Bleaching | 1 min. 00 sec. | 38° C. | 20 mL Bleaching solution overflow was entirely supplied to bleach-fix tank |
| Bleach-fix | 3 min. 15 sec. | 38° C. | 30 mL |
| Washing (1) | 40 sec. | 35° C. | counter flow piping from (2) to (1) |
| Washing (2) | 1 min. 00 sec. | 35° C. | 30 mL |
| Stabilization | 40 sec. | 38° C. | 20 mL |
| Drying | 1 min. 15 sec. | 55° C. | |

*The replenishment rate is represented by a value per 1.1 m of a 35-mm wide sample (equivalent to one 24 Ex. film).

The compositions of the processing solutions are presented below.

| (Color developer) | Tank solution (g) | Replenisher (g) |
|---|---|---|
| Diethylenetriamine pentaacetic acid | 1.0 | 1.1 |
| 1-hydroxyethylidene-1,1-diphosphonic acid | 2.0 | 2.0 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylaminesulfate | 2.4 | 2.8 |
| 4-[N-ethyl-N-(β-hydroxy ethyl)amino]-2-methyl aniline sulfate | 4.5 | 5.5 |
| Water to make | 1.0 L | 1.0 L |

-continued

| (Color developer) | Tank solution (g) | Replenisher (g) |
|---|---|---|
| pH (adjusted by potassium hydroxide and sulfuric acid) | 10.05 | 10.10 |

| (Bleaching Solution) common to tank solution and replenisher | (g) |
|---|---|
| Ferric ammonium ethylenediamine tetraacetate dihydrate | 120.0 |
| Disodium ethylenediamine tetraacetate | 10.0 |
| Ammonium bromide | 100.0 |
| Amnonium nitrate | 10.0 |
| Bleaching accelerator $(CH_3)_2N—CH_2—CH_2—S—S—CH_2—CH_2—N(CH_3)_2 \bullet 2HCl$ | 0.005 mol |
| Ammonia water (27%) | 15.0 mL |
| Water to make | 1.0 L |
| pH (adjusted by ammonia water and nitric acid) | 6.3 |

| (Bleach-fix solution) | Tank solution (g) | Replenisher (g) |
|---|---|---|
| Ferric ammonium ethylene diaminetetraacetate dihydrate | 50.0 | — |
| Disodium ethylenediamine tetraacetate | 5.0 | 2.0 |
| Sodium sulfite | 12.0 | 20.0 |
| Aqueous ammonium thiosulfate solution (700 g/l) | 240.0 mL | 400.0 mL |
| Ammonia water (27%) | 6.0 ml | — |
| Water to make | 1.0 L | 1.0 L |
| pH (adjusted by ammonia water and acetic acid) | 7.2 | 7.3 |
| (Washing water) common to tank solution and replenisher | | |

Tap water was supplied to a mixed-bed column filled with an H type strongly acidic cation exchange resin (Amberlite IR-120B: available from Rohm & Haas Co.) and an OH type strongly basic anion exchange resin (Amberlite IR-400) to set each of the concentrations of calcium ion and magnesium ion to be 3 mg/L or less. Subsequently, 20 mg/L of sodium isocyanuric acid dichloride and 0.15 g/L of sodium sulfate were added. The pH of the solution ranged from 6.5 to 7.5.

| (Stabilizer) common to tank solution and replenisher | (g) |
|---|---|
| Sodium p-toluenesulfinate | 0.03 |
| Polyoxyethylene-p-monononyl phenylether (average polymerization degree 10) | 0.2 |
| Disodium ethylenediaminetetraacetate | 0.05 |
| 1,2,4-triazole | 1.3 |
| 1,4-bis(1,2,4-triazole-1-ylmethyl) piperazine | 0.75 |
| Water to make | 1.0 L |
| pH | 8.5 |

The density of each processed sample was measured through a green filter. Also, the densities of samples stored at 50° C. and a relative humidity of 60% for 14 days before exposure were similarly measured to evaluate the storage stability.

Table 3 shows the sensitivity at a density of fog plus 0.2 and fog values obtained as described above. The sensitivity is represented as a relative value with respect to a sensitivity value of 100 of sample No. 1.

TABLE 3

| Sample No. | Host tabular grain emulsion | Epitaxial deposition method | Fresh properties | | Properties after storage | | Remarks |
|---|---|---|---|---|---|---|---|
| | | | Fog | Sensitivity | Fog | Sensitivity | |
| 1 | b | ① | 0.18 | 100 | 0.45 | 42 | Comparative example |
| 2 | b | ② | 0.15 | 120 | 0.43 | 56 | Comparative example |
| 3 | b | ③ | 0.10 | 67 | 0.16 | 26 | Comparative example |
| 4 | d | ① | 0.16 | 146 | 0.33 | 100 | Present invention |
| 5 | d | ② | 0.13 | 158 | 0.29 | 121 | Present invention |
| 6 | d | ③ | 0.11 | 170 | 0.18 | 151 | Present invention |
| 7 | e | ① | 0.12 | 180 | 0.26 | 140 | Present invention |
| 8 | e | ② | 0.11 | 188 | 0.24 | 163 | Present invention |
| 9 | e | ③ | 0.11 | 194 | 0.16 | 183 | Present invention |

As is apparent from Table 3, in each conventional emulsion having a low ratio of hexagonal tabular grains and a low ratio of perfect epitaxial tabular grains, variations in the fog and sensitivity after storage were extremely large. In contrast, the emulsion having a high ratio of perfect epitaxial tabular grains of the present invention had low fog and high sensitivity. Also, changes in the fog and sensitivity after storage were very small. The higher the ratio of hexagonal tabular grains and ratio of perfect epitaxial tabular grains, the larger the effects of the present invention.

EXAMPLE-2

During the coating of each emulsion of Example-1, $2.5\times10^{-3}$ mol of KBr was added per mol of silver of the emulsion, thereby evaluating the influence of the diffusion of bromine ions from other layers during the coating of multiple layers in a silver bromoiodide emulsion system. Table 4 summarizes changes in the fog and sensitivity before and after the addition of KBr. The sensitivity change was obtained by comparing the sensitivity values before and after the addition of KBr, i.e., comparing the values at a density of fog plus 0.2.

TABLE 4

| Host tabular grain emulsion | Epitaxial deposition method | Fog change | Sensitivity change | Remarks |
|---|---|---|---|---|
| b | ① | 0.06 | 33 | Comparative example |
| b | ② | 0.03 | 30 | Comparative example |
| b | ③ | 0.02 | 26 | Comparative example |
| d | ① | 0.04 | 14 | Present invention |
| d | ② | 0.02 | 10 | Present invention |
| d | ③ | 0.01 | 4 | Present invention |
| e | ① | 0.02 | 8 | Present invention |
| e | ② | 0.02 | 8 | Present invention |
| e | ③ | 0 | 0 | Present invention |

As shown in Table 4, the emulsion having a high ratio of perfect epitaxial tabular grains of the present invention changed the fog and sensitivity little when KBr was added. Changes in the fog and sensitivity were especially small in emulsions having a pBr of 3.5 or less.

EXAMPLE-3

The effects of emulsions of the present invention in a multilayered color photographic lightsensitive material will be described below.

Silver halide emulsions Em-A to Em-O were prepared by the following methods.

(Method for Preparing Em-A)

42.2 L of an aqueous solution containing 31.7 g of low-molecular-weight gelatin with a molecular weight of 15,000, which was phthalated at a phthalation ratio of 97%, and 31.7 g of KBr were vigorously stirred at 35° C. 1,583 mL of an aqueous solution containing 316.7 g of $AgNO_3$ and 1,583 mL of an aqueous solution containing 221.5 g of KBr and 52.7 g of low-molecular-weight gelatin with a molecular weight of 15,000 were added over 1 min by the double jet method. 52.8 g of KBr were added immediately after the addition, and 2,485 mL of an aqueous solution containing 398.2 g of $AgNO_3$ and 2,581 mL of an aqueous solution containing 291.1 g of KBr were added over 2 min by the double jet method. 44.8 g of KBr were added immediately after the addition. After that, the temperature was raised to 40° C. to ripen the material. After the ripening, 923 g of gelatin with a molecular weight of 100,000, which was phthalated at a phthalation ratio of 97%, and 79.2 g of KBr were added. Also, 15,947 mL of an aqueous solution containing 5,103 g of $AgNO_3$ and an aqueous KBr solution were added over 10 min by the double jet method while the flow rate was accelerated such that the final flow rate was 1.4 times the initial flow rate. During the addition, the silver potential was held at −60 mV with respect to a saturated calomel electrode. After washing with water, gelatin was added, the pH and the pAg were adjusted to 5.7 and 8.8, respectively, and the silver amount and the gelatin amount were adjusted to 131.8 g and 64.1 g, respectively, per kg of an emulsion, thereby preparing a seed emulsion. 1,211 mL of an aqueous solution containing 46 g of phthalated gelatin with a phthalation ratio of 97% and 1.7 g of KBr were vigorously stirred at 75° C. After 9.9 g of the seed emulsion were added, 0.3 g of modified silicone oil (the L7602 manufactured by Nippon Uniker K.K.) was added. $H_2SO_4$ was added to adjust the pH to 5.5, and 67.6 mL of an aqueous solution containing 7.0 g of $AgNO_3$ and an aqueous KBr solution were added over 6 min by the double jet method while the flow rate was accelerated such that the final flow rate was 5.1 times the initial flow rate. During the addition, the silver potential was held at −20 mV with respect to the saturated calomel electrode. After 2 mg of sodium benzenethiosulfonate and 2 mg of thiourea dioxide were added, 328 mL of an aqueous solution containing 105.6 g of $AgNO_3$ and an aqueous KBr solution were added over 56 min by the double jet method while the flow rate was accelerated such that the final flow rate was 3.7 times the initial flow rate. During the addition, an AgI fine-grain emulsion having a grain size of 0.037 μm was simultaneously added at an accelerated flow rate so that the silver iodide content was 27 mol %. Also, the silver potential was held at −50 mV with respect to the saturated calomel electrode. 121.3 mL of an aqueous solution containing 45.6 g of $AgNO_3$ and an aqueous KBr solution were added over 22 min by the double jet method. During the addition, the silver potential was held at +20 mV with respect to the saturated calomel electrode. The temperature was raised to 82° C., KBr was added to adjust the silver potential to −80 mV, and the abovementioned AgI fine-grain emulsion was added in an amount of 6.33 g as a KI weight. Immediately after the addition, 206.2 mL of an aqueous solution containing 66.4 g of $AgNO_3$ were added over 16 min. For the first 5 min of the addition, the silver potential was held at −80 mV by using an aqueous KBr solution. After washing with water, gelatin was added, and the pH and the pAg were adjusted to 5.8 and 8.7, respectively, at 40° C. Compounds 11 and 12 were added, and the temperature was raised to 60° C. After sensitizing dyes 11 and 12 were added, the emulsion was optimally chemically sensitized by adding potassium thiocyanate, chloroauric acid, sodium thiosulfate, and N,N-dimethylselenourea. At the end of this chemical sensitization, compounds 13 and 14 were added. "Optimally chemically sensitized" means that the addition amount of each of the sensitizing dyes and the compounds was $10^{-1}$ to $10^{-8}$ mol per mol of a silver halide.

Compound 11

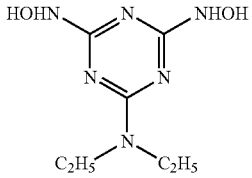

Compound 12

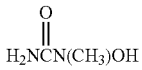

Sensitizing dye 11

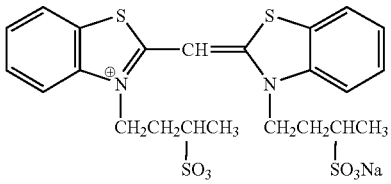

-continued

Sensitizing dye 12

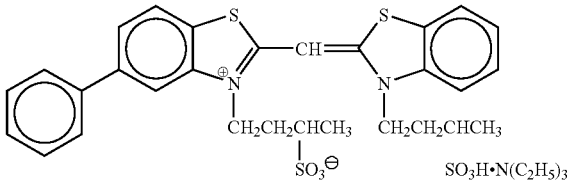

Compound 13

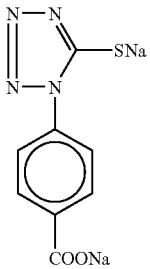

Compound 14

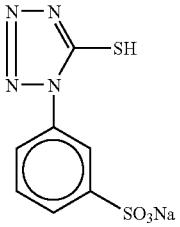

(Method for Preparing Em-B)

1,192 mL of an aqueous solution containing 0.96 g of low-molecular-weight gelatin and 0.9 g of KBr were vigorously stirred at 40° C. 37.5 mL of an aqueous solution containing 1.49 g of $AgNO_3$ and 37.5 mL of an aqueous solution containing 1.05 g of KBr were added over 30 sec by the double jet method. After 1.2 g of KBr were added, the temperature was raised to 75° C. to ripen the material. After the ripening, 35 g of trimellitated gelatin with a molecular weight of 100,000, formed by chemically modifying an amino group with trimellitic acid, were added, and the pH was adjusted to 7. 6 mg of thiourea dioxide were added. 116 mL of an aqueous solution containing 29 g of $AgNO_3$ and an aqueous KBr solution were added by the double jet method while the flow rate was accelerated such that the final flow rate was 3 times the initial flow rate. During the addition, the silver potential was held at −20 mV with respect to a saturated calomel electrode. 440.6 mL of an aqueous solution containing 110.2 g of $AgNO_3$ and an aqueous KBr solution were added over 30 min by the double jet method while the flow rate was accelerated such that the final flow rate was 5.1 times the initial flow rate. During the addition, the AgI fine-grain emulsion used in the preparation of Em-A was simultaneously added at an accelerated flow rate so that the silver iodide content was 15.8 mol %. Also, the silver potential was held at 0 mV with respect to the saturated calomel electrode. 96.5 mL of an aqueous solution containing 24.1 g of $AgNO_3$ and an aqueous KBr solution were added over 3 min by the double jet method. During the addition, the silver potential was held at 0 mV. After 26 mg of sodium ethylthiosulfonate were added, the temperature was lowered to 55° C., and an aqueous KBr solution was added to adjust the silver potential to −90 mV. The aforementioned AgI fine-grain emulsion was added in an amount of 8.5 g as a KI weight. Immediately after the addition, 228 mL of an aqueous solution containing 57 g of $AgNO_3$ were added over 5 min. During the addition, an aqueous KBr solution was used to adjust the potential at the end of the addition to +20 mV. The resultant emulsion was washed with water and chemically sensitized in substantially the same manner as for Em-A.

(Method for Preparing Em-C)

1,192 mL of an aqueous solution containing 1.02 g of phthalated gelatin containing 35 μmol of methionine per g and having a molecular weight of 100,000 and a phthalation ratio of 97% and 0.9 g of KBr were vigorously stirred at 35° C. 42 mL of an aqueous solution containing 4.47 g of $AgNO_3$ and 42 mL of an aqueous solution containing 3.16 g of KBr were added over 9 sec by the double jet method. After 2.6 g of KBr were added, the temperature was raised to 63° C. to ripen the material. After the ripening, 41.2 g of trimellitated gelatin with a molecular weight of 100,000, which was used in the preparation of Em-B, and 18.5 g of NaCl were added. After the pH was adjusted to 7.2, 8 mg of dimethylamineborane were added. 203 mL of an aqueous solution containing 26 g of $AgNO_3$ and an aqueous KBr solution were added by the double jet method such that the final flow rate was 3.8 times the initial flow rate. During the addition, the silver potential was held at −30 mV with respect to a saturated calomel electrode. 440.6 mL of an aqueous solution containing 110.2 g of $AgNO_3$ and an aqueous KBr solution were added over 24 min by the double jet method while the flow rate was accelerated such that the final flow rate was 5.1 times the initial flow rate. During the addition, the AgI fine-grain emulsion used in the preparation of Em-A was simultaneously added at an accelerated flow rate so that the silver iodide content was 2.3 mol %. Also, the silver potential was held at −20 mV with respect to the saturated calomel electrode. After 10.7 mL of an aqueous 1 N potassium thiocyanate solution were added, 153.5 mL of an aqueous solution containing 24.1 g of $AgNO_3$ and an aqueous KBr solution were added over 2 min 30 sec by the double jet method. During the addition, the silver potential was held at 10 mV. An aqueous KBr solution was added to adjust the silver potential to −70 mV. The aforementioned AgI fine-grain emulsion was added in an amount of 6.4 g as a KI weight. Immediately after the addition, 404 mL of an aqueous solution containing 57 g of $AgNO_3$ were added over 45 min. During the addition, an aqueous KBr solution was used to adjust the silver potential at the end of the addition to −30 mV. The resultant emulsion was washed with water and chemically sensitized in substantially the same manner as for Em-A.

(Method for Preparing Em-D)

In the preparation of Em-C, the $AgNO_3$ addition amount during nucleation was increased by 2.3 times. Also, in the final addition of 404 mL of an aqueous solution containing 57 g of $AgNO_3$, the silver potential at the end of the addition was adjusted to +90 mV by using an aqueous KBr solution. Em-D was prepared following substantially the same procedures as for Em-C except the foregoing.

(Method for Preparing Em-E)

1,200 mL of an aqueous solution containing 0.75 g of low-molecular-weight gelatin with a molecular weight of 15,000, 0.9 g of KBr, and 0.2 g of the modified silicone oil used in the preparation of Em-A were held at 39° C., adjusted to pH 1.8, and stirred with violence. An aqueous solution containing 0.45 g of $AgNO_3$ and an aqueous KBr solution containing 1.5 mol % of KI were added over 16 sec by the double jet method. During the addition, the excess KBr concentration was held constant. The temperature was raised to 54° C. to ripen the material. After the ripening, 20 g of phthalated gelatin containing 35 μmol of methionine per g and having a molecular weight of 100,000 and a phthalation ratio of 97% were added. After the pH was adjusted to 5.9, 2.9 g of KBr were added. 288 mL of an aqueous solution containing 28.8 g of $AgNO_3$ and an aqueous KBr solution were added over 53 min by the double jet method. During the addition, the AgI fine-grain emulsion used in the preparation of Em-A was simultaneously added such that the silver iodide content was 4.1 mol %. Also, the silver potential was held at −60 mV with respect to a saturated calomel electrode. After 2.5 g of KBr were added, an aqueous solution containing 87.7 g of $AgNO_3$ and an aqueous KBr solution were added over 63 min by the double jet method while the flow rate was accelerated so that the final flow rate was 1.2 times the initial flow rate. During the addition, the abovementioned AgI fine-grain emulsion was simultaneously added at an accelerated flow rate such that the silver iodide content was 10.5 mol %. Also, the silver potential was held at −70 mV. After 1 mg of thiourea dioxide was added, 132 mL of an aqueous solution containing 41.8 g of $AgNO_3$ and an aqueous KBr solution were added over 25 min by the double jet method. The addition of the aqueous KBr solution was so adjusted that the silver potential at the end of the addition was +20 mV. After 2 mg of sodium benzenethiosulfonate were added, the pH was adjusted to 7.3, and KBr was added to adjust the silver potential to −70 mV. After that, the aforementioned AgI fine-grain emulsion was added in an amount of 5.73 g as a KI weight. Immediately after the addition, 609 mL of an aqueous solution containing 66.4 g of $AgNO_3$ were added over 10 min. For the first 6 min of the addition, the silver potential was held at −70 mV by an aqueous KBr solution. After washing with water, gelatin was added, and the pH and the pAg were adjusted to 6.5 and 8.2, respectively, at 40° C. Compounds 1 and 2 were added, and the temperature was raised to 56° C. After 0.0004 mol of the aforementioned AgI fine-grain emulsion was added per mol of silver, sensitizing dyes 13 and 14 were added. The emulsion was optimally chemically sensitized by adding potassium thiocyanate, chloroauric acid, sodium thiosulfate, and N,N-dimethylselenourea. At the end of the chemical sensitization, the compounds 13 and 14 were added.

Sensitizing dye 13

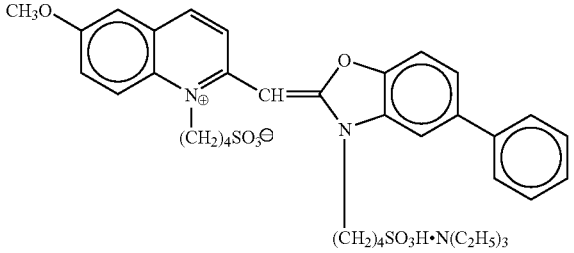

-continued

Sensitizing dye 14

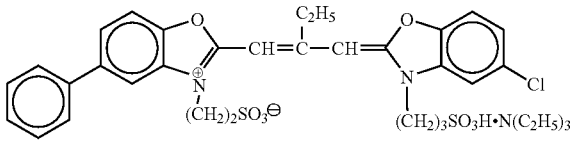

(Method for Preparing Em-F)

Em-F was prepared following substantially the same procedures as for Em-E except that the $AgNO_3$ addition amount during the nucleation was increased 4.12 times. Note that the sensitizing dyes in Em-E were changed to sensitizing dyes 12, 15, 16, and 17.

Sensitizing dye 15

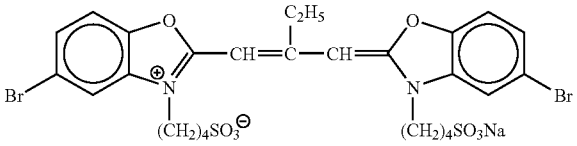

Sensitizing dye 16

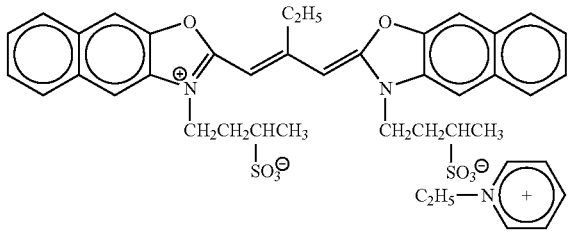

Sensitizind dye 17

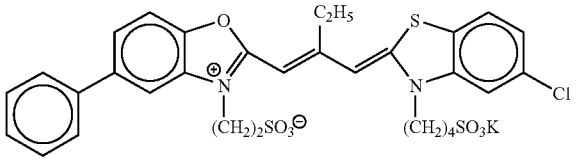

(Method for Preparing Em-G)

1,200 mL of an aqueous solution containing 0.70 g of low-molecular-weight gelatin with a molecular weight of 15,000, 0.9 g of KBr, 0.175 g of KI, and 0.2 g of the modified silicone oil used in the preparation of Em-A were held at 33° C., adjusted to pH 1.8, and stirred with violence. An aqueous solution containing 1.8 g of $AgNO_3$ and an aqueous KBr solution containing 3.2 mol % of KI were added over 9 sec by the double jet method. During the addition, the excess KBr concentration was held constant. The temperature was raised to 62° C. to ripen the material. After the ripening, 27.8 g of trimellitated gelatin containing 35 μmol of methionine per g and having a molecular weight of 100,000, which was formed by chemically modifying an amino group with trimellitic acid, were added. After the pH was adjusted to 6.3, 2.9 g of KBr were added. 270 mL of an aqueous solution containing 27.58 g of $AgNO_3$ and an aqueous KBr solution were added over 37 min by the double jet method. During the addition, an AgI fine-grain emulsion having a grain size of 0.008 μm was simultaneously added such that the silver iodide content was 4.1 mol %. This AgI fine-grain emulsion was prepared, immediately before the addition, by mixing an aqueous solution of low-molecular-weight gelatin with EL molecular weight of 15,000, an aqueous $AgNO_3$ solution, and an aqueous KI solution in another chamber having a magnetic coupling induction type stirrer described in JP-A-10-43570. Also, the silver potential was held at −60 mV with respect to a saturated calomel electrode. After 2.6 g of KBr were added, an aqueous solution containing 87.7 g of $AgNO_3$ and an aqueous KBr solution were added over 49 min by the double jet method while the flow rate was accelerated so that the final flow rate was 3.1 times the initial flow rate. During the addition, the aforementioned AgI fine-grain emulsion prepared by mixing immediately before addition was simultaneously added at an accelerated flow rate such that the silver iodide content was 7.9 mol %. Also, the silver potential was held at −70 mV. After 1 mg of thiourea dioxide was added, 132 mL of an aqueous solution containing 41.8 g of $AgNO_3$ and an aqueous KBr solution were added over 20 min by the double jet method. The addition of the aqueous KBr solution was so adjusted that the potential at the end of the addition was +20 mV. After the temperature was raised to 78° C. and the pH was adjusted to 9.1, KBr was added to adjust the potential to −60 mV. The AgI fine-grain emulsion used in the preparation of Em-A was added in an amount of 5.73 g as a KI weight. Immediately after the addition, 321 mL of an aqueous solution containing 66.4 g of $AgNO_3$ were added over 4 min. For the first 2 min of the addition, the silver potential was held at −60 mV by an aqueous KBr solution. The resultant emulsion was washed with water and chemically sensitized in substantially the same manner as for Em-F.

(Method for Preparing Em-H)

An aqueous solution containing 17.8 g of ion-exchanged gelatin with a molecular weight of 100,000, 6.2 g of KBr, and 0.46 g of KI was vigorously stirred at 45° C. An aqueous solution containing 11.85 g of $AgNO_3$ and an aqueous solution containing 3.8 g of KBr were added over 45 sec by the double jet method. After the temperature was raised to 63° C., 24.1 g of ion-exchanged gelatin with a molecular weight of 100,000 were added to ripen the material. After the ripening, an aqueous solution containing 133.4 g of $AgNO_3$ and an aqueous KBr solution were added over 20 min by the double jet method such that the final flow rate was 2.6 times the initial flow rate. During the addition, the silver potential was held at +40 mV with respect to a saturated calomel electrode. Also, ten minutes after the start of the addition, 0.1 mg of $K_2IrCl_6$ was added. After 7 g of NaCl were added, an aqueous solution containing 45.6 g of $AgNO_3$ and an aqueous KBr solution were added over 12 min by the double jet method. During the addition, the silver potential was held at +90 mV. Also, over 6 min from the start of the addition, 100 mL of an aqueous solution containing 29 mg of yellow prussiate of potash were added. After 14.4 g of KBr were added, the AgI fine-grain emulsion used in the preparation of Em-A was added in an amount of 6.3 g as a KI weight. Immediately after the addition, an aqueous solution containing 42.7 g of $AgNO_3$ and an aqueous KBr solution were added over 11 min by the double jet method. During the addition, the silver potential was held at +90 mv. The resultant emulsion was washed with water and chemically sensitized in substantially the same manner as for Em-F.

(Method for Preparing Em-I)

Em-I was prepared following substantially the same procedures as for Em-H except that the temperature during the nucleation was changed to 35° C.

(Method for Preparing Em-J)

1,200 mL of an aqueous solution containing 0.38 g of phthalated gelatin with a phthalation ratio of 97% and a molecular weight of 100,000 and 0.9 g of KBr were held at 60° C., adjusted to pH 2, and stirred with violence. An aqueous solution containing 1.96 g of $AgNO_3$ and an aqueous solution containing 1.67 g of KBr and 0.172 g of KI were added over 30 sec by the double jet method. After ripening, 12.8 g of trimellitated gelatin containing 35 μmol of methionine per g and having a molecular weight of 100,000, which was formed by chemically modifying an amino group with trimellitic acid, were added. After the pH was adjusted to 5.9, 2.99 g of KBr and 6.2 g of NaCl were added. 60.7 mL of an aqueous solution containing 27.3 g of $AgNO_3$ and an aqueous KBr solution were added over 31 min by the double jet method. During the addition, the silver potential was held at −50 mV with respect to a saturated calomel electrode. An aqueous solution containing 65.6 g of $AgNO_3$ and an aqueous KBr solution were added over 37 min by the double jet method while the flow rate was accelerated so that the final flow rate was 2.1 times the initial flow rate. During the addition, the AgI fine-grain emulsion used in the preparation of Em-A was simultaneously added at an accelerated flow rate such that the silver iodide content was 6.5 mol %. Also, the silver potential was held at −50 mV. After 1.5 mg of thiourea dioxide were added, 132 mL of an aqueous solution containing 41.8 g of $AgNO_3$ and an aqueous KBr solution were added over 13 min by the double jet method. The addition of the aqueous KBr solution was so adjusted that the silver potential at the end of the addition was +40 mV. After 2 mg of sodium benzenethiosulfonate were added, KBr was added to adjust the silver potential to −100 mV. The abovementioned AgI fine-grain emulsion was added in an amount of 6.2 g as a KI weight. Immediately after the addition, 300 mL of an aqueous solution containing 88.5 g of $AgNO_3$ were added over 8 min. An aqueous KBr solution was added to adjust the potential at the end of the addition to +60 mV. After washing with water, gelatin was added, and the pH and the pAg were adjusted to 6.5 and 8.2, respectively, at 40° C. After the compounds 11 and 12 were added, the temperature was raised to 61° C. Sensitizing dyes 18, 19, 20, and 21 were added. After that, the emulsion was optimally chemically sensitized by adding $K_2IrCl_6$, potassium thiocyanate, chloroauric acid, sodium thiosulfate, and N,N-dimethylselenourea. At the end of the chemical sensitization, the compounds 13 and 14 were added.

Sensitizing dye 18

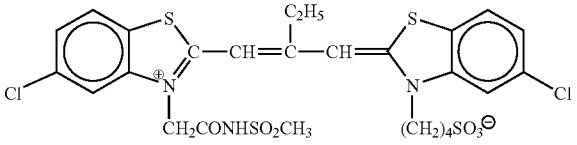

Sensitizing dye 19

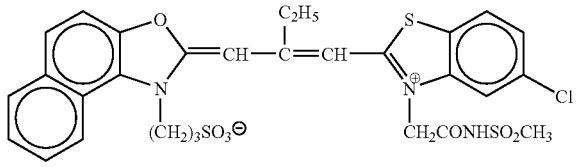

-continued

Sensitizing dye 20

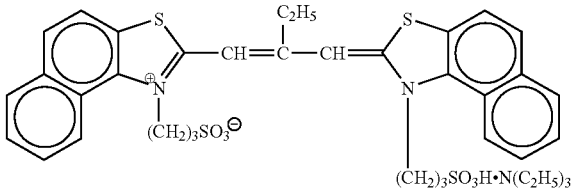

Sensitizing dye 21

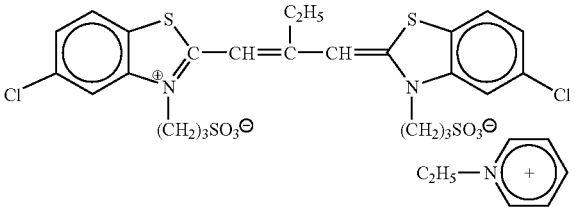

(Method for Preparing Em-K)

1,200 mL of an aqueous solution containing 4.9 g of low-molecular-weight gelatin with a molecular weight of 15,000 and 5.3 g of KBr were vigorously stirred at 60° C. 27 mL of an aqueous solution containing 8.75 g of $AgNO_3$ and 36 mL of an aqueous solution containing 6.45 g of KBr were added over 1 min by the double jet method. The temperature was raised to 75° C., and 21 mL of an aqueous solution containing 6.9 g of $AgNO_3$ were added over 2 min. After 26 g of $NH_4NO_3$ and 56 mL of 1 N NaOH were sequentially added, the material was ripened. After the ripening, the pH was adjusted to 4.8. 438 mL of an aqueous solution containing 141 g of $AgNO_3$ and 458 mL of an aqueous solution containing 102.6 g of KBr were added by the double jet method such that the final flow rate was 4 times the initial flow rate. The temperature was lowered to 55° C., and 240 mL of an aqueous solution containing 7.1 g of $AgNO_3$ and an aqueous solution containing 6.46 g of KI were added over 5 min by the double jet method. After 7.1 g of KBr were added, 4 mg of sodium benzenethiosulfonate and 0.05 mg of $K_2IrCl_6$ were added. 177 mL of an aqueous solution containing 57.2 g of $AgNO_3$ and 223 mL of an aqueous solution containing 40.2 g of KBr were added over 8 min by the double jet method. The resultant emulsion was washed with water and chemically sensitized in substantially the same manner as for Em-J.

(Method for Preparing Em-L)

Em-L was prepared following substantially the same procedures as for Em-K except that the temperature during the nucleation was changed to 40° C.

(Methods for Preparing Em-M, Em-N, and Em-O)

Em-M, Em-N, and Em-O were prepared following substantially the same procedures as for Em-H or Em-I except that chemical sensitization was performed in substantially the same manner as for Em-J.

The characteristic values of the silver halide emulsions Em-A to Em-O are summarized in Table 5.

TABLE 5

| Emulsion No. | Equivalent-circle diameter (μm) Variation coefficient (%) | Thickness (μm) Variation coefficient (%) | Aspect ratio Variation coefficient (%) | Tabularity | Twin plane spacing (μm) Variation coefficient (%) | Ratio (%) occupied in total projected area by tabular grains | Ratio (%) of (100) faces in side faces | I content (mol %) Variation coefficient (%) | Cl content (mol %) | Surface I content (mol %) |
|---|---|---|---|---|---|---|---|---|---|---|
| Em-A | 1.98 | 0.198 | 10 | 51 | 0.014 | 92 | 23 | 15 | 0 | 4.3 |
| | 23 | 28 | 35 | | 32 | | | 17 | | |
| Em-B | 1.30 | 0.108 | 12 | 111 | 0.013 | 93 | 22 | 11 | 0 | 3.6 |
| | 25 | 27 | 38 | | 30 | | | 16 | | |
| Em-C | 1.00 | 0.083 | 12 | 145 | 0.012 | 93 | 18 | 4 | 1 | 1.8 |
| | 27 | 26 | 37 | | 30 | | | 8 | | |
| Em-D | 0.75 | 0.075 | 10 | 133 | 0.010 | 91 | 33 | 4 | 2 | 1.9 |
| | 31 | 18 | 29 | | 27 | | | 8 | | |
| Em-E | 2.02 | 0.101 | 20 | 198 | 0.013 | 99 | 20 | 7 | 0 | 2.4 |
| | 31 | 19 | 42 | | 33 | | | 7 | | |
| Em-F | 1.54 | 0.077 | 20 | 260 | 0.013 | 99 | 23 | 7 | 0 | 2.5 |
| | 26 | 18 | 33 | | 26 | | | 7 | | |
| Em-G | 1.08 | 0.072 | 15 | 208 | 0.008 | 97 | 23 | 6 | 0 | 2.0 |
| | 18 | 15 | 19 | | 22 | | | 5 | | |
| Em-H | 0.44 | 0.22 | 2 | 9 | 0.013 | 90 | 38 | 3 | 2 | 1 |
| | 16 | 13 | 9 | | 18 | | | 6 | | |
| Em-I | 0.33 | 0.165 | 2 | 12 | 0.013 | 88 | 42 | 3 | 2 | 1 |
| | 17 | 13 | 12 | | 18 | | | 6 | | |
| Em-J | 1.83 | 0.122 | 15 | 123 | 0.012 | 98 | 23 | 5 | 1 | 1.8 |
| | 18 | 20 | 22 | | 19 | | | 6 | | |
| Em-K | 1.09 | 0.156 | 7 | 45 | 0.013 | 99 | 22 | 3 | 0 | 2.7 |
| | 16 | 18 | 19 | | 16 | | | 7 | | |
| Em-L | 0.84 | 0.12 | 7 | 58 | 0.013 | 99 | 25 | 3 | 0 | 2.7 |
| | 17 | 18 | 19 | | 16 | | | 7 | | |
| Em-M | 0.55 | 0.275 | 2 | 7 | 0.013 | 90 | 38 | 2 | 2 | 1 |
| | 16 | 13 | 9 | | 18 | | | 6 | | |
| Em-N | 0.44 | 0.22 | 2 | 9 | 0.013 | 88 | 42 | 2 | 2 | 1 |
| | 17 | 13 | 12 | | 18 | | | 6 | | |
| Em-O | 0.33 | 0.165 | 2 | 12 | 0.013 | 88 | 46 | 1 | 2 | 0.5 |
| | 17 | 13 | 12 | | 18 | | | 6 | | |

1) Support

A support used in this example was formed as follows.

100 parts by weight of a polyethylene-2,6-naphthalate polymer and 2 parts by weight of Tinuvin P.326 (manufactured by Ciba-Geigy Co.) as an ultraviolet absorbent were dried, melted at 300° C., and extruded from a T-die. The resultant material was longitudinally oriented by 3.3 times at 140° C., laterally oriented by 3.3 times at 130° C., and thermally fixed at 250° C. for 6 sec, thereby obtaining a 90-μm thick PEN (polyethylenenaphthalate) film. Note that proper amounts of blue, magenta, and yellow dyes (I-1, I-4, I-6, I-24, I-26, I-27, and II-5 described in Journal of Technical Disclosure No. 94-6023) were added to this PEN film. The PEN film was wound around a stainless steel core of 20 cm in diameter and given a thermal history of 110° C. and 48 hr, manufacturing a support with a high resistance to curling.

2) Coating of Undercoat Layer

The two surfaces of the support were subjected to corona discharge, UV discharge, and glow discharge. After that, each surface of the support was coated with an undercoat solution (10 cc/m$^2$, by using a bar coater) consisting of 0.1 g/m$^2$ of gelatin, 0.01 g/m$^2$ of sodium α-sulfodi-2-ethylhexylsuccinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$, and 0.02 g/m$^2$ of a polyamido-epichlorohydrin polycondensation product, thereby forming an undercoat layer on a side at a high temperature upon orientation. Drying was performed at 115° C. for 6 min (all rollers and conveyors in the drying zone were at 115° C.).

3) Coating of Back Layers

One surface of the undercoated support was coated with an antistatic layer, magnetic recording layer, and slip layer having the following compositions as back layers.

3-1) Coating of Antistatic Layer

The surface was coated with 0.2 g/m$^2$ of a dispersion (secondary aggregation grain size=about 0.08 μm) of a fine-grain powder having a specific resistance of 5 Ω·cm of a tin oxide-antimony oxide composite material with an average grain size of 0.005 μm, together with 0.05 g/m$^2$ of gelatin, 0.02 g/m$^2$ of $(CH_2{=}CHSO_2CH_2CH_2NHCO)_2CH_2$, 0.005 g/m$^2$ of polyoxyethylene-p-nonylphenol (polymerization degree 10), and resorcin.

3-2) Coating of Magnetic Recording Layer

A bar coater was used to coat the surface with 0.06 g/m$^2$ of cobalt-γ-iron oxide (specific area 43 m$^2$/g, major axis 0.14 μm, minor axis 0.03 μm, saturation magnetization 89 emu/g, $Fe^{+2}/Fe^{+3}$=6/94, the surface was treated with 2 wt % of iron oxide by aluminum oxide silicon oxide) coated with 3-poly (polymerization degree 15)oxyethylene-propyloxytrimethoxysilane (15 wt %), together with 1.2 g/m$^2$ of diacetylcellulose (iron oxide was dispersed by an open kneader and sand mill), by using 0.3 g/m$^2$ of $C_2H_5C(CH_2OCONH{-}C_6H_3(CH_3)NCO)_3$ as a hardener and acetone, methylethylketone, and cyclohexanone as solvents, thereby forming a 1.2-μm thick magnetic recording layer. 10 mg/m$^2$ of silica grains (0.3 μm) were added as a matting agent, and 10 mg/m$^2$ of aluminum oxide (0.15 μm) coated with 3-poly (polymerization degree 15)oxyethylene-propyloxytrimethoxysilane (15 wt %) were added as a polishing agent.

Drying was performed at 115° C. for 6 min (all rollers and conveyors in the drying zone were at 115° C.). The color density increase of $D^B$ of the magnetic recording layer measured by an X-light (blue filter) was about 0.1. The saturation magnetization moment, coercive force, and squareness ratio of the magnetic recording layer were 4.2 emu/g, $7.3\times10^4$ A/m, and 65%, respectively.

3-3) Preparation of Slip Layer

The surface was then coated with diacetylcellulose (25 mg/m$^2$) and a mixture of $C_6H_{13}CH(OH)C_{10}H_{20}COOC_{40}H_{81}$ (compound a, 6 mg/m$^2$)/$C_{50}H_{101}O(CH_2CH_2O)_{16}H$ (compound b, 9 mg/m$^2$). Note that this mixture was melted in xylene/propylenemonomethylether (1/1) at 105° C. and poured and dispersed in propylenemonomethylether (tenfold amount) at room temperature. After that, the resultant mixture was formed into a dispersion (average grain size 0.01 μm) in acetone before being added. 15 mg/m$^2$ of silica grains (0.3 μm) were added as a matting agent, and 15 mg/m$^2$ of aluminum oxide (0.15 μm) coated with 3-poly(polymerization degree 15)oxyethylene-propyloxytrimethoxysiliane (15 wt %) were added as a polishing agent. Drying was performed at 115° C. for 6 min (all rollers and conveyors in the drying zone were at 115° C.). The resultant slip layer was found to have excellent characteristics; the coefficient of kinetic friction was 0.06 (5 mmØ stainless steel hard sphere, load 100 g, speed 6 cm/min), and the coefficient of static friction was 0.07 (clip method). Also, the coefficient of kinetic friction (to be described later) between an emulsion surface and the slip layer was 0.12, indicating an excellent characteristic.

4) Coating of Sensitive Layers

The surface of the support on the side away from the back layers formed as above was coated with a plurality of layers having the following compositions to form a sample 201 as a color negative sensitive material.

(Compositions of Sensitive Layers)

The main materials used in the individual layers are classified as follows.

ExC: Cyan coupler
ExM: Magenta coupler
ExY: Yellow coupler
UV: Ultraviolet absorbent
HBS: High-boiling organic solvent
H: Gelatin hardener (In the following description, practical compounds have numbers attached to their symbols. Formulas of these compounds will be presented later.)

The number corresponding to each component indicates the coating amount represented in units of g/m$^2$. The coating amount of a silver halide is indicated by the amount of silver.

| | | |
|---|---|---|
| 1st layer (1st antihalation layer) | | |
| Black colloidal silver | silver | 0.155 |
| 0.07-μm, surface-fogged AgBrI(2) | silver | 0.01 |
| Gelatin | | 0.87 |
| ExC-1 | | 0.002 |
| ExC-3 | | 0.002 |
| Cpd-2 | | 0.001 |
| HBS-1 | | 0.004 |
| HBS-2 | | 0.002 |
| 2nd layer (2nd antihalation layer) | | |
| Black colloidal silver | silver | 0.066 |
| Gelatin | | 0.407 |

-continued

| | | |
|---|---|---|
| ExM-1 | | 0.050 |
| ExF-1 | | $2.0\times10^{-3}$ |
| HBS-1 | | 0.074 |
| Solid disperse dye ExF-2 | | 0.015 |
| Solid disperse dye ExF-3 | | 0.020 |
| 3rd layer (Interlayer) | | |
| 0.07-μm AgBrI(2) | | 0.020 |
| ExC-2 | | 0.022 |
| Polyethylacrylate latex | | 0.085 |
| Gelatin | | 0.294 |
| 4th layer (Low-speed red-sensitive emulsion layer) | | |
| Silver iodobromide emulsion M | silver | 0.065 |
| Silver iodobromide emulsion N | silver | 0.100 |
| Silver iodobromide emulsion O | silver | 0.158 |
| ExC-1 | | 0.109 |
| ExC-3 | | 0.044 |
| ExC-4 | | 0.072 |
| ExC-5 | | 0.011 |
| ExC-6 | | 0.003 |
| Cpd-2 | | 0.025 |
| Cpd-4 | | 0.025 |
| HBS-1 | | 0.17 |
| Gelatin | | 0.80 |
| 5th layer (Medium-speed red-sensitive emulsion layer) | | |
| Silver iodobromide emulsion K | silver | 0.21 |
| Silver iodobromide emulsion L | silver | 0.62 |
| ExC-1 | | 0.14 |
| ExC-2 | | 0.026 |
| ExC-3 | | 0.020 |
| ExC-4 | | 0.12 |
| ExC-5 | | 0.016 |
| ExC-6 | | 0.007 |
| Cpd-2 | | 0.036 |
| Cpd-4 | | 0.028 |
| HBS-1 | | 0.16 |
| Gelatin | | 1.18 |
| 6th layer (High-speed red-sensitive emulsion layer) | | |
| Silver iodobromide emulsion J | silver | 1.47 |
| ExC-1 | | 0.18 |
| ExC-3 | | 0.07 |
| ExC-6 | | 0.029 |
| ExC-7 | | 0.010 |
| ExY-5 | | 0.008 |
| Cpd-2 | | 0.046 |
| Cpd-4 | | 0.077 |
| HBS-1 | | 0.25 |
| HBS-2 | | 0.12 |
| Gelatin | | 2.12 |
| 7th layer (Interlayer) | | |
| Cpd-1 | | 0.089 |
| Solid disperse dye ExF-4 | | 0.030 |
| HBS-1 | | 0.050 |
| Polyethylacrylate latex | | 0.83 |
| Gelatin | | 0.84 |
| 8th layer (layer for donating interimage effect to red-sensitive layer) | | |
| Silver iodobromide emulsion E | silver | 0.560 |
| Cpd-4 | | 0.030 |
| ExM-2 | | 0.096 |
| ExM-3 | | 0.028 |
| ExY-1 | | 0.031 |
| ExG-1 | | 0.006 |
| HBS-1 | | 0.085 |
| HBS-3 | | 0.003 |
| Gelatin | | 0.58 |
| 9th layer (Low-speed green-sensitive emulsion layer) | | |
| Silver iodobromide emulsion G | silver | 0.39 |
| Silver iodobromide emulsion H | silver | 0.28 |
| Silver iodobromide emulsion I | silver | 0.35 |
| ExM-2 | | 0.36 |
| ExM-3 | | 0.045 |
| ExG-1 | | 0.005 |

-continued

| | | |
|---|---|---|
| HBS-1 | | 0.28 |
| HBS-3 | | 0.01 |
| HBS-4 | | 0.27 |
| Gelatin | | 1.39 |
| 10th layer (Medium-speed green-sensitive emulsion layer) | | |
| Silver iodobromide emulsion F | silver | 0.20 |
| Silver iodobromide emulsion G | silver | 0.25 |
| ExC-6 | | 0.009 |
| ExM-2 | | 0.031 |
| ExM-3 | | 0.029 |
| ExY-1 | | 0.006 |
| ExM-4 | | 0.028 |
| ExG-1 | | 0.005 |
| HBS-1 | | 0.064 |
| HBS-3 | | $2.1 \times 10^{-3}$ |
| Gelatin | | 0.44 |
| 11th layer (High-speed green-sensitive emulsion layer) | | |
| Emulsion of Example-1 | silver | 0.99 |
| ExC-6 | | 0.004 |
| ExM-1 | | 0.016 |
| ExM-3 | | 0.036 |
| ExM-4 | | 0.020 |
| ExM-5 | | 0.004 |
| ExY-5 | | 0.003 |
| ExM-2 | | 0.013 |
| ExG-1 | | 0.005 |
| Cpd-4 | | 0.007 |
| HBS-1 | | 0.18 |
| Polyethylacrylate latex | | 0.099 |
| Gelatin | | 1.11 |
| 12th layer (Yellow filter layer) | | |
| Yellow colloidal silver | silver | 0.047 |
| Cpd-1 | | 0.16 |
| Solid disperse dye ExF-5 | | 0.010 |
| Solid disperse dye ExF-6 | | 0.153 |
| HBS-1 | | 0.082 |
| Gelatin | | 1.057 |
| 13th layer (Low-speed blue-sensitive emulsion layer) | | |
| Silver iodobromide emulsion B | silver | 0.18 |
| Silver iodobromide emulsion C | silver | 0.20 |
| Silver iodobromide emulsion D | silver | 0.07 |
| ExC-1 | | 0.041 |
| ExC-8 | | 0.012 |
| ExY-1 | | 0.035 |
| ExY-2 | | 0.71 |
| ExY-3 | | 0.10 |
| ExY-4 | | 0.005 |
| Cpd-2 | | 0.10 |
| Cpd-3 | | $4.0 \times 10^{-3}$ |
| HBS-1 | | 0.24 |
| Gelatin | | 1.41 |
| 14th layer (High-speed blue-sensitive emulsion layer) | | |
| Silver iodobromide emulsion A | silver | 0.75 |
| ExC-1 | | 0.013 |
| ExY-2 | | 0.31 |
| ExY-3 | | 0.05 |
| ExY-6 | | 0.062 |
| Cpd-2 | | 0.075 |
| Cpd-3 | | $1.0 \times 10^{-3}$ |
| HBS-1 | | 0.10 |
| Gelatin | | 0.91 |
| 15th layer (1st protective layer) | | |
| 0.07-μm AgBrI(2) | silver | 0.30 |
| UV-1 | | 0.21 |
| UV-2 | | 0.13 |
| UV-3 | | 0.20 |
| UV-4 | | 0.025 |
| F-18 | | 0.009 |
| F-19 | | 0.005 |
| F-20 | | 0.005 |
| HBS-1 | | 0.12 |

-continued

| | |
|---|---|
| HBS-4 | $5.0 \times 10^{-2}$ |
| Gelatin | 2.3 |
| 16th layer (2nd protective layer) | |
| H-1 | 0.40 |
| B-1 (diameter 1.7 μm) | $5.0 \times 10^{-2}$ |
| B-2 (diameter 1.7 μm) | 0.15 |
| B-3 | 0.05 |
| S-1 | 0.20 |
| Gelatin | 0.75 |

In addition to the above components, to improve the storage stability, processability, resistance to pressure, antiseptic and mildewproofing properties, antistatic properties, and coating properties, the individual layers contained W-1 to W-5, B-4 to B-6, F-1 to F-18, iron salt, lead salt, gold salt, platinum salt, palladium salt, iridium salt, ruthenium salt, and rhodium salt. Additionally, a sample was manufactured by adding $8.5\times10^{-3}$ g and $7.9\times10^{-3}$ g, per mol of a silver halide, of calcium in the form of an aqueous calcium nitrate solution to the coating solutions of the 8th and 11th layers, respectively.

Samples 201 to 209 described in Table 6 were formed by changing the emulsion of Example 1 contained in the 11th layer.

Preparation of Dispersions of Organic Solid Disperse Dyes

ExF-3 was dispersed by the following method. That is, 21.7 mL of water, 3 mL of a 5% aqueous solution of p-octylphenoxyethoxyethanesulfonic acid soda, and 0.5 g of a 5% aqueous solution of p-octylphenoxypolyoxyethyleneether (polymerization degree 10) were placed in a 700-mL pot mill, and 5.0 g of the dye ExF-3 and 500 mL of zirconium oxide beads (diameter 1 mm) were added to the mill. The contents were dispersed for 2 hr by using a BO type oscillating ball mill manufactured by Chuo Koki K.K. The dispersion was extracted from the mill and added to 8 g of a 12.5% aqueous solution of gelatin. The beads were filtered away to obtain a gelatin dispersion of the dye. The average grain size of the fine dye grains was 0.24 μm.

Following the same procedure as above, a solid dispersion of ExF-4 was obtained. The average grain size of the fine dye grains was found to be 0.45 μm. ExF-2 was dispersed by a microprecipitation dispersion method described in Example 1 of EP549,489A. The average grain size was found to be 0.06 μm.

A solid dispersion of EXF-6 was dispersed by the following method.

4,000 g of water and 376 g of a 3% solution of W-2 were added to 2,800 g of a wet cake of EXF-6 containing 18% of water, and the resultant material was stirred to form a slurry of EXF-6 having a concentration of 32%. Subsequently, ULTRA VISCO MILL (UVM-2) manufactured by Imex K.K. was filled with 1,700 mL of zirconia beads having an average grain size of 0.5 mm. The slurry was milled by passing it through the mill for 8 hr at a peripheral speed of about 10 m/sec and a discharge amount of 0.5 L/min. The average grain size was found to be 0.52 μm.

Compounds used in the formation of each layer above were as follows.

ExC-1
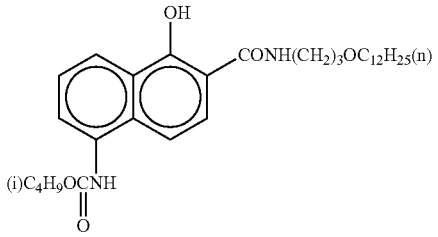
ExC-2
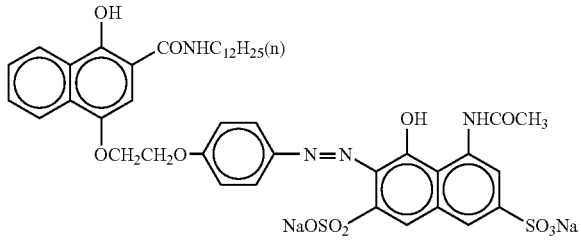
ExC-3
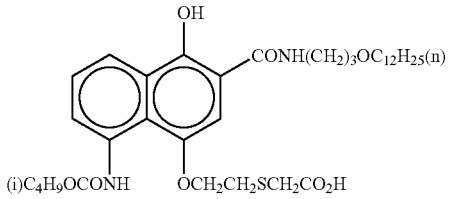
ExC-4
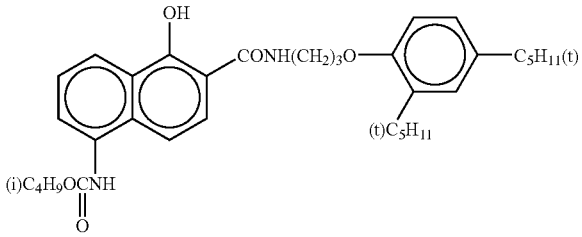
ExC-5
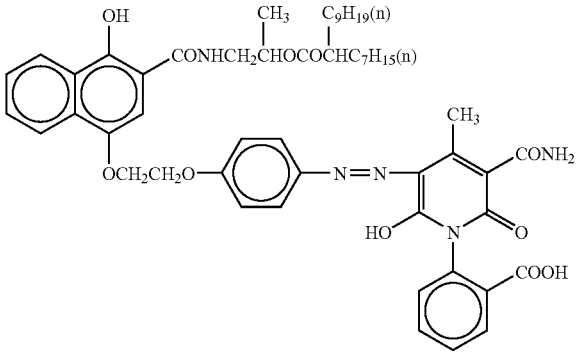
ExC-6
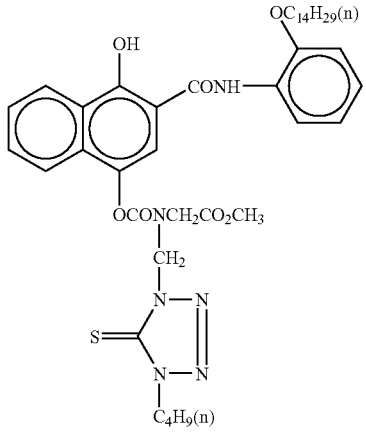
ExC-7
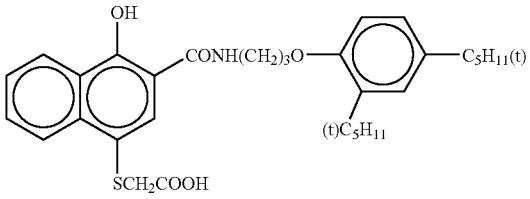
ExC-8
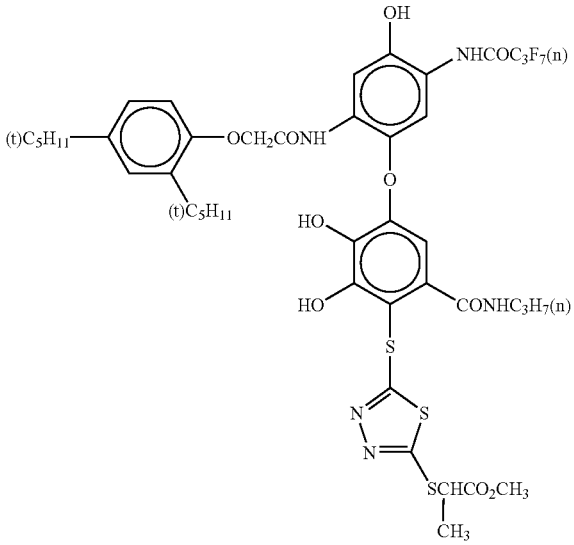

-continued
ExM-1
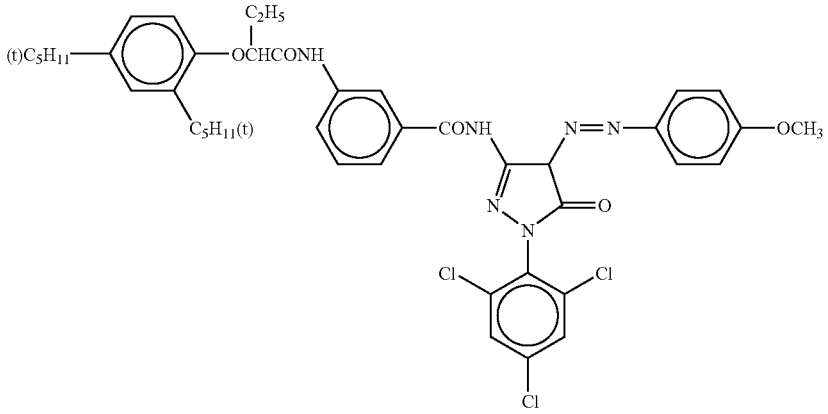
ExM-2
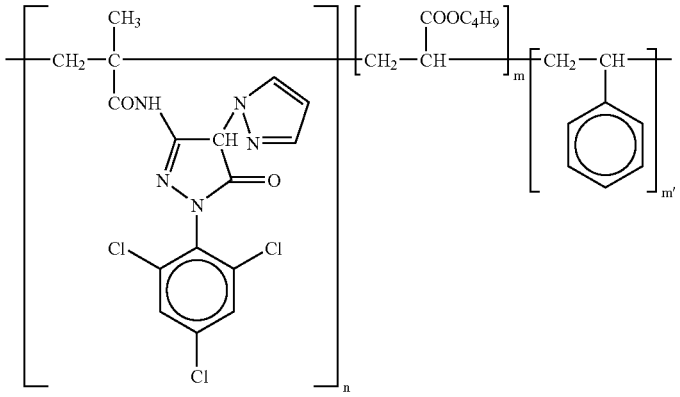
n = 50
m = 25
m′ = 25
mol. wt. about 20,000
ExM-3
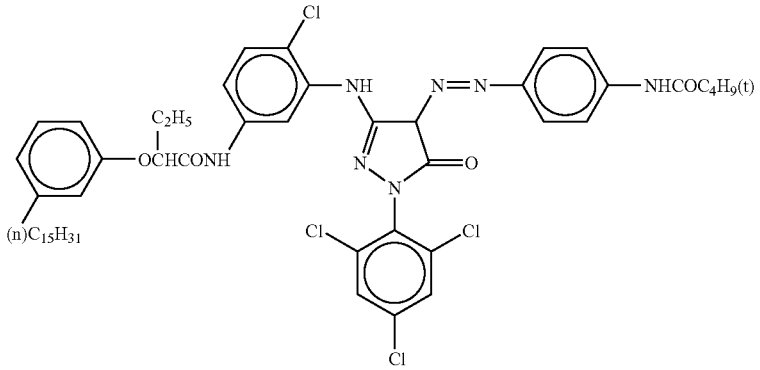
ExM-4
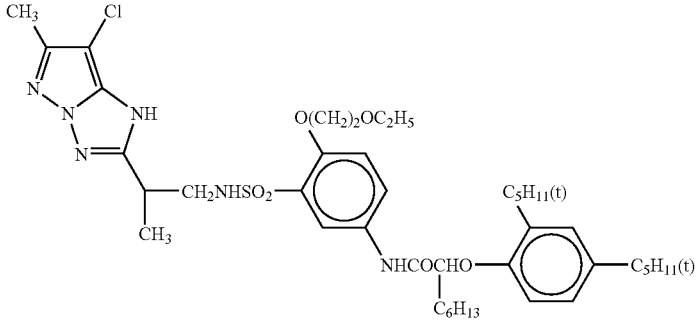

-continued
ExM-5
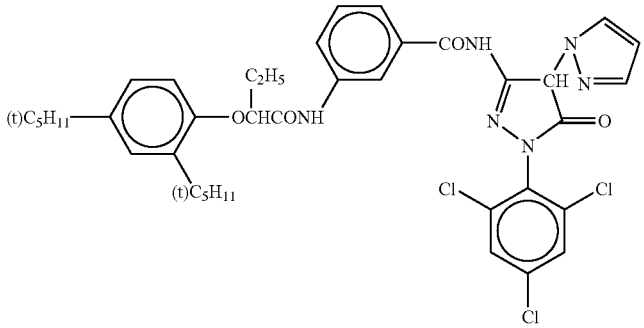
ExY-1
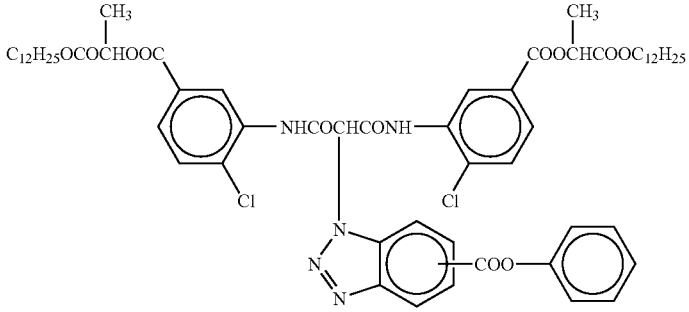
ExY-2
ExY-3
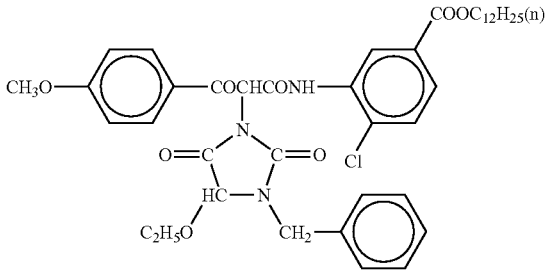
ExY-4
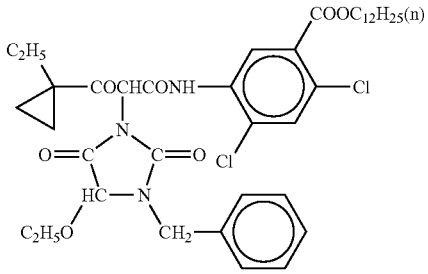
ExY-5
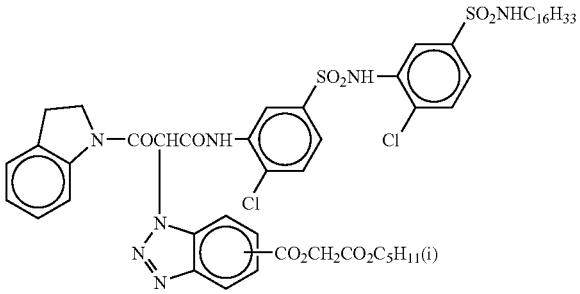
ExG-1
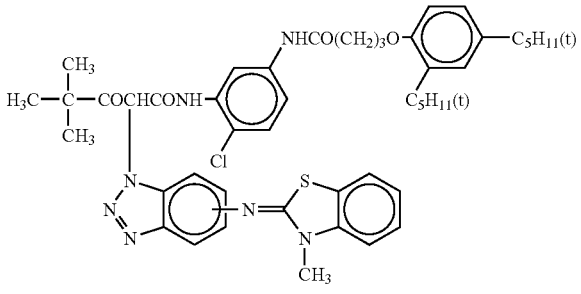
ExY-6
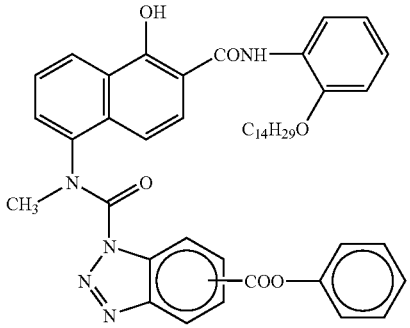
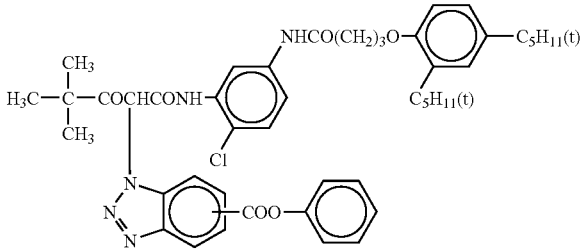

-continued
ExF-1
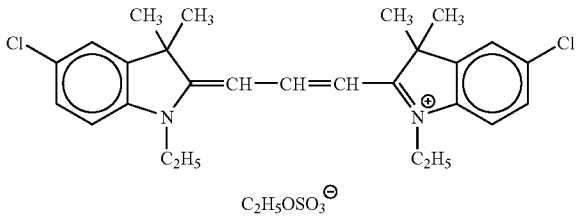
ExF-2
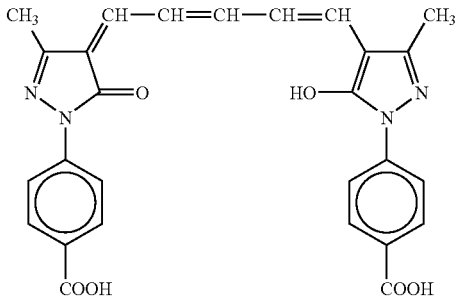
ExF-3
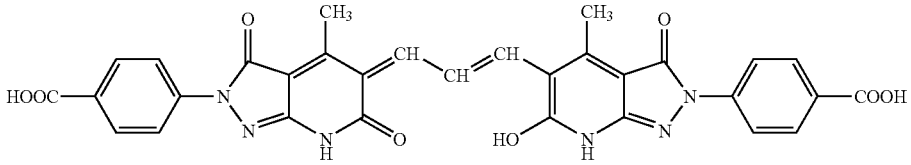
ExF-4
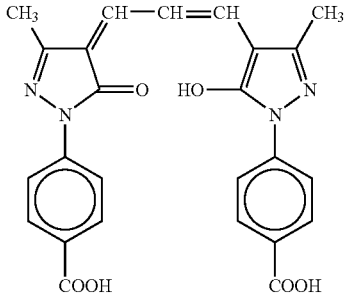
ExF-5
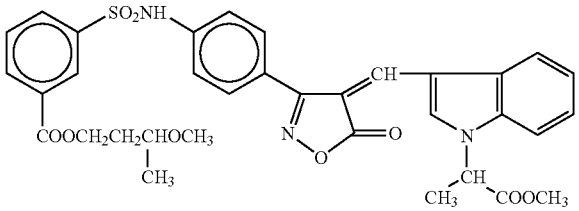
ExF-6
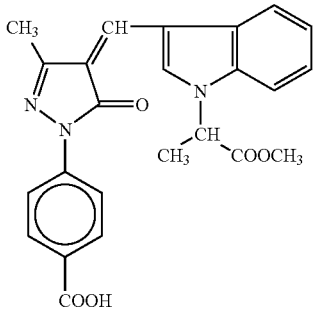
Cpd-1
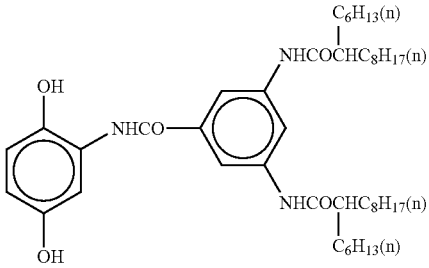
Cpd-2
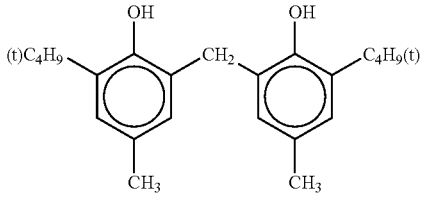
Cpd-3
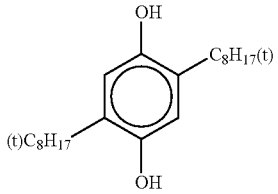
Cpd-4
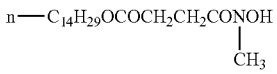
UV-1
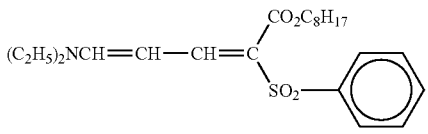

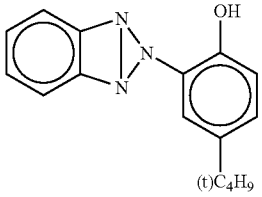

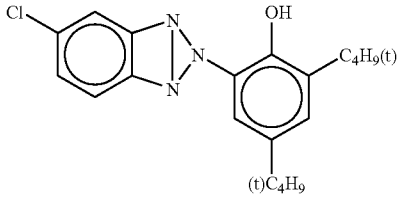

Di-n-butyl phthalate

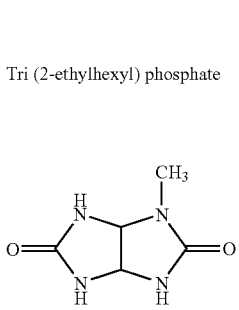

Tri (2-ethylhexyl) phosphate

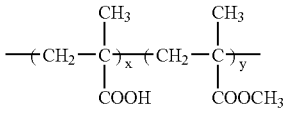

x/y = 40/60 (weight ratio)
Average molecular
weight: about 20,000

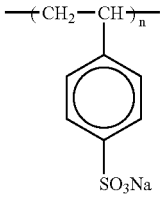

Average molecular
weight: about 750,000

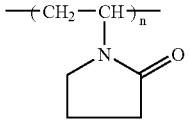

Average molecular
weight: about 10,000

-continued

UV-2

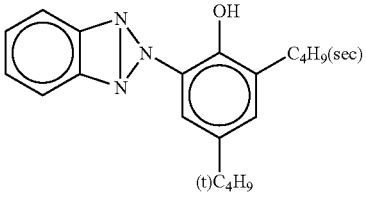

UV-3

UV-4

Tricresyl phosphate

HBS-1

HBS-2

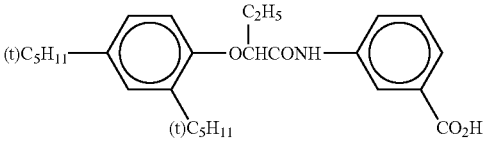

HBS-3

HBS-4

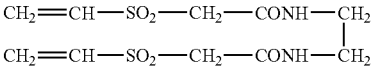

H-1

S-1

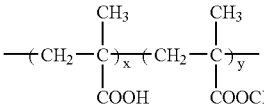

x/y = 10/90 (weight ratio)
Average molecular
weight: about 35,000

B-1

B-2

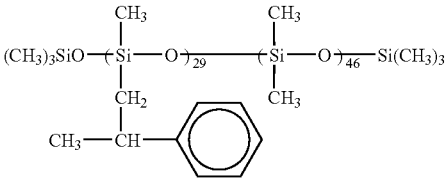

(molar ratio)
Average molecular
weight: about 8,000

B-3

B-4

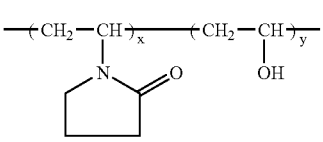

x/y = 70/30 (weight ratio)
Average molecular
weight: about 17,000

B-5

B-6

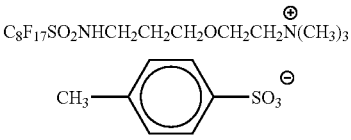

W-1

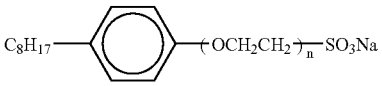
n = 2-4
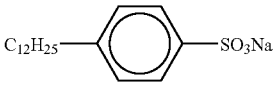
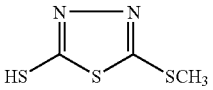
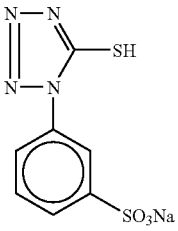
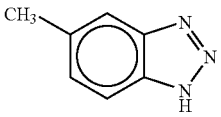
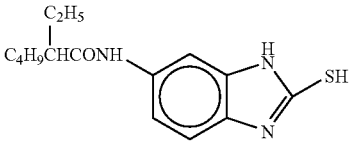
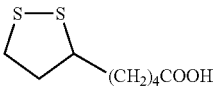
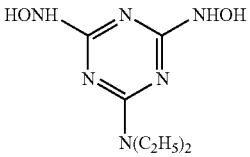
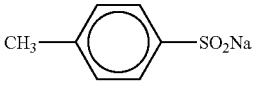
-continued
W-2
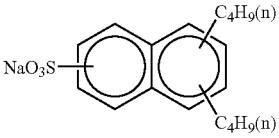
W-3
W-4
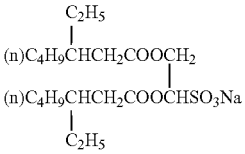
W-5
F-1
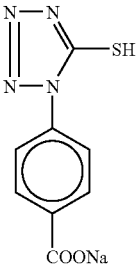
F-2
F-3
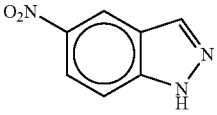
F-4
F-5
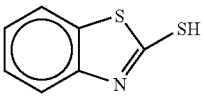
F-6
F-7
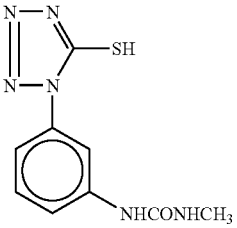
F-8
F-9
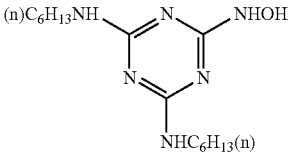
F-10
F-11
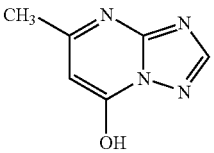
F-12
F-13
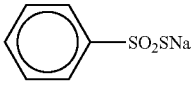
F-14

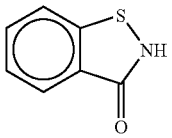

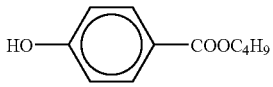

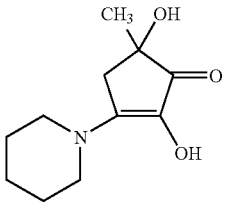

-continued

F-15

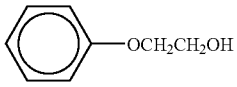

F-16

F-17

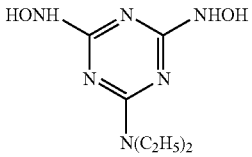

F-18

F-19

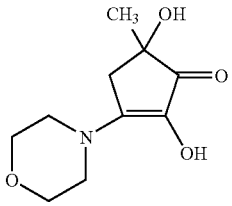

F-20

These samples were subjected to film hardening for 14 hr at 40° C. and a relative humidity of 70%. After that, the samples were exposed for 1/100 sec through the SC-39 gelatin filter (a long-wavelength light transmitting filter having a cutoff wavelength of 390 nm) manufactured by Fuji Photo Film Co., Ltd. and through a continuous wedge. Development was performed as follows by using the FP-360B automatic processor manufactured by Fuji Photo Film Co., Ltd. Note that the FP-360B was modified such that the overflow solution of the bleaching bath was entirely discharged to a waste solution tank without being supplied to the subsequent bath. This FP-360B includes an evaporation correcting means described in JIII Journal of Technical Disclosure No. 94-4992.

The processing steps and the processing solution compositions are presented below.

(Processing Steps)

| Step | Time | Temperature | Replenishment rate* | Tank volume |
|---|---|---|---|---|
| Color development | 3 min 5 sec | 37.8° C. | 20 mL | 11.5 L |
| Bleaching | 50 sec | 38.0° C. | 5 mL | 5 L |
| Fixing (1) | 50 sec | 38.0° C. | — | 5 L |
| Fixing (2) | 50 sec | 38.0° C. | 8 mL | 5 L |
| Washing | 30 sec | 38.0° C. | 17 mL | 3 L |
| Stabilization (1) | 20 sec | 38.0° C. | — | 3 L |
| Stabilization (2) | 20 sec | 38.0° C. | 15 mL | 3 L |
| Drying | 1 min 30 sec | 60.0° C. | | |

*The replenishment rate was per 1.1 m of a 35-mm wide sensitive material (equivalent to one 24 Ex. 1)

The stabilizer and fixer were returned from (2) to (1) by counterflow, and the overflow of washing water was entirely introduced to the fixing bath (2). Note that the amounts of the developer, bleaching solution, and fixer carried over to the bleaching step, fixing step, and washing step, respectively, were 2.5 mL, 2.0 mL, and 2.0 mL, respectively, per 1.1 m of a 35-mm wide sensitive material. Note also that each crossover time was 6 sec, and this time was included in the processing time of each preceding step.

The aperture areas of the processor were 100 $cm^2$ for the color developer, 120 $cm^2$ for the bleaching solution, and about 100 $cm^2$ for the other processing solutions.

The compositions of the processing solutions are presented below.

| | Tank solution (g) | Replenisher (g) |
|---|---|---|
| (Color developer) | | |
| Diethylenetriamine pentaacetic acid | 3.0 | 3.0 |
| Disodium cathecol-3,5-disulfonate | 0.3 | 0.3 |
| Sodium sulfite | 3.9 | 5.3 |
| Potassium carbonate | 39.0 | 39.0 |
| Disodium-N,N-bis(2-sulfonateethyl) hydroxylamine | 1.5 | 2.0 |
| Potassium bromide | 1.3 | 0.3 |
| Potassium iodide | 1.3 mg | — |
| 4-hydroxy-6-methyl-1,3,3a,7-tetrazaindene | 0.05 | — |
| Hydroxylamine sulfate | 2.4 | 3.3 |
| 2-methyl-4-[N-ethyl-N-(β-hydroxyethyl)amino] aniline sulfate | 4.5 | 6.5 |
| Water to make | 1.0 L | 1.0 L |
| pH (adjusted by potassium hydroxide and sulfuric acid) | 10.05 | 10.18 |
| (Bleaching solution) | | |
| Ferric ammonium 1,3-diaminopropanetetra acetate monohydrate | 113 | 170 |
| Ammonium bromide | 70 | 105 |
| Ammonium nitrate | 14 | 21 |
| Succinic acid | 34 | 51 |
| Maleic acid | 28 | 42 |
| Water to make | 1.0 L | 1.0 L |
| pH (adjusted by ammonia water) | 4.6 | 4.0 |
| (Fixing (1) tank solution) | | |

A 5:95 (volume ratio) mixture of the above bleaching tank solution and the following fixing tank solution (pH 6.8).

-continued

| | Tank solution (g) | Replenisher (g) |
|---|---|---|
| (Fixing (2)) | | |
| Aqueous ammonium thiosulfate solution (750 g/L) | 240 mL | 720 mL |
| Imidazole | 7 | 21 |
| Ammonium methane thiosulfonate | 5 | 15 |
| Ammonium methane sulfinate | 10 | 30 |
| Ethylenediamine tetraacetic acid | 13 | 39 |
| Water to make | 1.0 L | 1.0 L |
| pH (adjusted by ammonia water and acetic acid) | 7.4 | 7.45 |

(Washing Water)

Tap water was supplied to a mixed-bed column filled with an H type strongly acidic cation exchange resin (Amberlite IR-120B: available from Rohm & Haas Co.) and an OH type strongly basic anion exchange resin (Amberlite IR-400) to set each of the concentrations of calcium ion and magnesium ion to be 3 mg/L or less. Subsequently, 20 mg/L of sodium isocyanuric acid dichloride and 150 mg/L of sodium sulfate were added. The pH of the solution ranged from 6.5 to 7.5.

| (Stabilizer) common to tank solution and replenisher | (g) |
|---|---|
| Sodium p-toluenesulfinate | 0.03 |
| Polyoxyethylene-p-monononylphenylether (average polymerization degree 10) | 0.2 |
| 1,2-benzoisothiazoline-3-one•sodium | 0.10 |
| Disodium ethylenediaminetetraacetate | 0.05 |
| 1,2,4-triazole | 1.3 |
| 1,4-bis(1,2,4-triazole-1-ylmethyl) piperazine | 0.75 |
| Water to make | 1.0 L |
| pH | 8.5 |

The same processing was performed by halving the replenishment rate of the color developer. The results are shown in Table 6. The sensitivity is the value at a density of fog plus 2.0 and is represented by a relative value with respect to a sensitivity value of 100 of sample No. 201.

As shown in Table 6, a sensitive material having high sensitivity and improved development dependence can be obtained by using emulsions of the present invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide photographic emulsion comprising grains, wherein not less than 85% of the total projected area of the grains are occupied by tabular grains meeting requirements (i) to (vi) below:

(i) silver bromochloroiodide grains having (111) faces as major surfaces, (ii) hexagonal grains having a ratio of the length of an edge having the maximum length to the length of an edge having the minimum length of not more than 2, (iii) perfect epitaxial grains having a total of six epitaxial junctions each existing only in each of six apex portions of the hexagonal grains, (iv) the silver chloride content is 1 to 6 mol %, (v) the silver iodide content is 0.5 to 10 mol %, and (vi) the silver bromide content of the epitaxial portion is 50 mol % or more.

2. The emulsion according to claim 1, wherein said tabular grains further meet the following requirement:

(vii) an equivalent-circle diameter is not less than 0.6 μm and a thickness is not more than 0.2 μm.

3. The emulsion according to claim 1, wherein the variation coefficient of the equivalent-circle diameters of all the grains is not more than 30%.

4. The emulsion according to claim 1, wherein said tabular grains further meet the following requirement:

(viii) an equivalent-circle diameter is not less than 1.0 μm and a thickness is not more than 0.1 μm.

5. The emulsion according to claim 1, wherein the perfect epitaxial grains defined in said requirement (iii) have no dislocation line except in the epitaxial apex portions.

6. The emulsion according to claim 1, wherein said tabular grains further meet the following requirement:

TABLE 6

| Sample | Host tabular grain | Epitaxial deposition | Standard development | | Half replenishment rate | | |
|---|---|---|---|---|---|---|---|
| No. | emulsion | method | Fog | Sensitivity | Fog | Sensitivity | Remarks |
| 201 | b | ① | 0.15 | 100 | 0.12 | 62 | Comparative example |
| 202 | b | ② | 0.15 | 130 | 0.12 | 73 | Comparative example |
| 203 | b | ③ | 0.13 | 93 | 0.11 | 50 | Comparative example |
| 204 | d | ① | 0.14 | 166 | 0.12 | 124 | Present invention |
| 205 | d | ② | 0.14 | 180 | 0.12 | 146 | Present invention |
| 206 | d | ③ | 0.12 | 210 | 0.11 | 180 | Present invention |
| 207 | e | ① | 0.13 | 190 | 0.11 | 166 | Present invention |
| 208 | e | ② | 0.12 | 210 | 0.11 | 170 | Present invention |
| 209 | e | ③ | 0.11 | 233 | 0.10 | 210 | Present invention |

(ix) the silver chloride content of each individual tabular grain is 0.7 to 1.3 CL mol %, wherein CL mol % is the average silver chloride content of all the grains.

7. The emulsion according to claim 1, wherein said tabular grains further meet the following requirement:

(x) the silver iodide content of each individual tabular grain is 0.7 to 1.3 I mol %, wherein I mol % is the average silver iodide content of all the grains.

8. A silver halide photographic lightsensitive material having a sensitive layer on a support, wherein the sensitive layer contains the silver halide photographic emulsion according to claim 1.

9. The emulsion according to claim 1, wherein the pBr of the emulsion at 40° C. is not more than 3.5.

10. A silver halide photographic emulsion comprising grains, wherein not less than 70% of the total projected area of the grains are occupied by tabular grains meeting requirements (i) to (v) below:

(i) silver bromochloroiodide grains having (111) faces as major surfaces, (ii) hexagonal grains having a ratio of the length of an edge having the maximum length to the length of an edge having the minimum length of not more than 2, (iii) perfect epitaxial grains having a total of six epitaxial junctions each existing only in each of six apex portions of the hexagonal grains, (iv) the silver chloride content is 1 to 6 mol %, and (v) the silver iodide content is 0.5 to 10 mol %, wherein the pBr of the emulsion at 40° C. is not more than 3.5.

11. A method of preparing a silver halide photographic emulsion comprising grains, wherein not less than 70% of the total projected area of the grains are occupied by tabular grains meeting requirements (i) to (v) below:

(i) silver bromochloroiodide grains having (111) faces as major surfaces, (ii) hexagonal grains having a ratio of the length of an edge having the maximum length to the length of an edge having the minimum length of not more than 2, (iii) perfect epitaxial grains having a total of six epitaxial junctions each existing only in each of six apex portions of the hexagonal grains, (iv) the silver chloride content is 1 to 6 mol %, and (v) the silver iodide content is 0.5 to 10 mol %, said method comprising adding a sensitizing dye to the host tabular grains before the epitaxial junctions are fonned.

12. A method of preparing a silver halide photographic emulsion comprising grains, wherein not less than 70% of the total projected area of the grains are occupied by tabular grains meeting requirements (i) to (v) below:

(i) silver bromochloroiodide grains having (111) faces as major surifices, (ii) hexagonal grains having a ratio of the length of an edge having the maximum length to the length of an edge having the minimum length of not more than 2, (iii) perfect epitaxial grains having a total of six epitaxial junctions each existing only in each of six apex portions of the hexagonal grains, (iv) the silver chloride content is 1 to 6 mol %, and (v) the silver iodide content is 0.5 to 10 mol %, said method comprising setting pBr of the emulsion during the formation of the epitaxial junction to 4.0 or more.

13. A method of preparing a silver halide photographic emulsion comprising grains, wherein not less than 70% of the total projected area of the grains are occupied by tabular grains meeting requirements (i) to (v) below:

(i) silver bromochloroiodide grains having (111) faces as major surfaces, (ii) hexagonal grains having a ratio of the length of an edge having the maximum length to the length of an edge having the minimum length of not more than 2, (iii) perfect epitaxial grains having a total of six epitaxial junctions each existing only in each of six apex portions of the hexagonal grains, (iv) the silver chloride content is 1 to 6 mol %, and (v) the silver iodide content is 0.5 to 10 mol %, said method comprising setting pBr of the emulsion at 40° C. after the formation of the epitaxial junction to 15 or less.

* * * * *